US008701588B2

(12) United States Patent
Clarke

(10) Patent No.: US 8,701,588 B2
(45) Date of Patent: Apr. 22, 2014

(54) BOOKMARKS INCLUDING COUPLING FEATURES AND RELATED METHODS

(75) Inventor: S. David Clarke, Centerville, UT (US)

(73) Assignee: Franklin Mill, LLC, Salt Lake City, UT (US)

( * ) Notice: Subject to any disclaimer, the term of this patent is extended or adjusted under 35 U.S.C. 154(b) by 317 days.

(21) Appl. No.: 13/157,556

(22) Filed: Jun. 10, 2011

(65) Prior Publication Data

US 2012/0312223 A1 Dec. 13, 2012

(51) Int. Cl.
*B42D 9/00* (2006.01)

(52) U.S. Cl.
USPC ..... 116/239; 24/265 EC; 24/67.9; 24/555; 24/563; 24/198

(58) Field of Classification Search
USPC ..... 116/234, 235, 236, 237, 238, 239; 24/67.9, 129 B, 198, 200, 265 BC, 24/265 EC, 265 R, 316, 545, 546, 555, 563; 281/42; D19/34
See application file for complete search history.

(56) References Cited

U.S. PATENT DOCUMENTS

| | | | | |
|---|---|---|---|---|
| 94,334 | A | 8/1869 | Odell | |
| 308,942 | A | 12/1884 | Yewell | |
| 472,632 | A | 4/1892 | Watson | |
| 616,438 | A | 12/1898 | Newkirk | |
| 678,533 | A | 7/1901 | Bancker | |
| 745,884 | A | 12/1903 | Morton | |
| 803,464 | A * | 10/1905 | Beck | 24/339 |
| 841,940 | A | 1/1907 | Crandall | |
| 911,783 | A | 2/1909 | Traver | |
| 1,043,425 | A | 11/1912 | Hirsh | |
| 1,070,683 | A | 8/1913 | Hale | |
| RE13,680 | E | 1/1914 | Hirsh | |
| 1,112,813 | A * | 10/1914 | Lane | 281/42 |
| D49,616 | S | 9/1916 | McKee | |
| 1,269,025 | A | 6/1918 | Watts | |
| 1,540,777 | A * | 6/1925 | Hellerman | 116/239 |
| 1,710,062 | A | 2/1927 | Moore | |
| 1,621,008 | A | 3/1927 | Fricker | |
| 1,816,910 | A | 4/1929 | Moore | |
| 1,790,649 | A | 2/1931 | Baumgarten | |
| 1,898,429 | A | 5/1931 | Domenego | |
| 1,847,184 | A * | 3/1932 | Hellerman | 116/239 |
| 1,894,533 | A | 3/1932 | Dempsey | |

(Continued)

FOREIGN PATENT DOCUMENTS

| | | |
|---|---|---|
| DE | 19822314 | 11/1999 |
| DE | 202006013833 | 12/2006 |

(Continued)

*Primary Examiner* — R. A. Smith
(74) *Attorney, Agent, or Firm* — Stoel Rives LLP

(57) ABSTRACT

Bookmarks can include a base that can couple with a cover of a book and a ribbon that can be attached to the base. For some bookmarks, the base includes a display body that can be positioned at an exterior of a cover of a book when the bookmark is coupled with the book, and also includes a rigid body coupled with the display body such that the rigid body can be positioned at an interior of the cover of the book when the bookmark is coupled with the book. The rigid body can include a coupling assist region having a cavity that extends rearwardly relative to the display body. An edge of a book cover can be received into the cavity before being advanced between clamping portions that are defined by the display body and the rigid body.

17 Claims, 21 Drawing Sheets

(56) References Cited

U.S. PATENT DOCUMENTS

| | | | | | |
|---|---|---|---|---|---|
| 1,857,488 | A | | 5/1932 | Weeks | |
| 1,919,971 | A | | 12/1932 | Wulkop | |
| 1,961,527 | A | | 6/1934 | Petro | |
| D111,781 | S | * | 10/1938 | Brennan | D19/34 |
| 2,202,787 | A | * | 5/1940 | Zumft | 116/237 |
| 2,265,507 | A | | 12/1941 | Anderson | |
| 2,341,121 | A | | 2/1944 | Schaaff | |
| 2,394,372 | A | | 3/1945 | Evans | |
| 2,387,607 | A | * | 10/1945 | Pascoo | 116/239 |
| D153,539 | S | | 9/1946 | Oatman | |
| 2,449,319 | A | * | 9/1948 | Polak | 116/238 |
| D167,016 | S | | 6/1952 | Zaccone | |
| 2,664,847 | A | * | 1/1954 | Orman | 116/239 |
| D178,766 | S | | 9/1956 | Cressaty | |
| 3,020,876 | A | | 8/1959 | Riden | |
| 2,901,801 | A | | 9/1959 | Girodet | |
| 2,911,940 | A | * | 11/1959 | Greider | 116/239 |
| 3,011,471 | A | | 11/1960 | Tam | |
| 3,059,609 | A | | 4/1961 | Sealana | |
| 3,161,931 | A | | 12/1964 | Zif | |
| 3,222,745 | A | | 12/1965 | Palmleaf et al. | |
| 3,242,542 | A | | 3/1966 | Tako | |
| D216,741 | S | | 3/1970 | Bosma | |
| 3,513,806 | A | * | 5/1970 | Ferrick | 116/237 |
| 3,604,067 | A | | 9/1971 | Brown | |
| 3,670,691 | A | | 6/1972 | Anderson | |
| 3,858,279 | A | | 1/1975 | Brattstrom | |
| D235,174 | S | | 5/1975 | Gardner | |
| 3,898,951 | A | | 8/1975 | Clare | |
| 4,024,832 | A | | 5/1977 | Machnikowski | |
| 4,226,006 | A | | 10/1980 | Toyama | |
| 4,436,053 | A | * | 3/1984 | Zeisky | 116/237 |
| D275,177 | S | | 8/1984 | Villanueva | |
| D292,071 | S | | 9/1987 | Weir | |
| 4,689,858 | A | | 9/1987 | Barber | |
| D295,501 | S | | 5/1988 | Brayford | |
| 4,838,198 | A | * | 6/1989 | Knox | 116/239 |
| 4,932,351 | A | | 6/1990 | Capamaggio | |
| 4,941,434 | A | | 7/1990 | Ellwanger | |
| D311,209 | S | | 10/1990 | Svee | |
| D313,627 | S | | 1/1991 | Diaz | |
| D313,815 | S | | 1/1991 | Bloch | |
| 5,022,342 | A | * | 6/1991 | Davis | 116/236 |
| 5,103,758 | A | | 4/1992 | Clark | |
| 5,244,232 | A | | 9/1993 | Dulberger | |
| 5,309,605 | A | * | 5/1994 | Sato | 24/67.9 |
| 5,375,884 | A | | 12/1994 | Farrington | |
| 5,408,950 | A | | 4/1995 | Porto | |
| D358,429 | S | | 5/1995 | Ely | |
| 5,443,029 | A | | 8/1995 | Garnet | |
| D365,363 | S | | 12/1995 | Terino | |
| 5,503,102 | A | | 4/1996 | McDonnell | |
| 5,515,809 | A | | 5/1996 | Weinberg | |
| 5,632,225 | A | | 5/1997 | Krasner | |
| D384,373 | S | | 9/1997 | Wong | |
| D393,813 | S | | 4/1998 | Herdt | |
| D410,679 | S | | 6/1999 | Blanchard et al. | |
| 5,970,777 | A | | 10/1999 | Hunt et al. | |
| D429,498 | S | | 8/2000 | Mershon | |
| D437,613 | S | | 2/2001 | Melnyk | |
| 6,197,396 | B1 | | 3/2001 | Haas et al. | |
| 6,205,947 | B1 | | 3/2001 | Drew | |
| D452,881 | S | | 1/2002 | Chien | |
| 6,352,048 | B1 | | 3/2002 | Scott | |
| 6,484,365 | B1 | | 11/2002 | Thompson | |
| D466,929 | S | | 12/2002 | Haas | |
| D474,235 | S | | 5/2003 | Haas | |
| D476,683 | S | | 7/2003 | Kilburn | |
| D489,410 | S | | 5/2004 | Ivey | |
| D492,351 | S | * | 6/2004 | Sato et al. | D19/65 |
| D494,223 | S | | 8/2004 | Best et al. | |
| D497,377 | S | | 10/2004 | Waggoner et al. | |
| D504,159 | S | | 4/2005 | Best et al. | |
| D518,100 | S | | 3/2006 | Salander et al. | |
| 7,040,051 | B2 | | 5/2006 | Windorski | |
| 7,055,861 | B1 | | 6/2006 | Lee | |
| 7,059,637 | B2 | | 6/2006 | Stewart et al. | |
| D529,375 | S | | 10/2006 | Cetera | |
| 7,125,049 | B2 | | 10/2006 | Goldberg et al. | |
| D534,584 | S | | 1/2007 | Goldberg et al. | |
| D536,735 | S | | 2/2007 | Johnson | |
| D537,752 | S | | 3/2007 | Goldberg et al. | |
| D551,705 | S | | 9/2007 | Mershon | |
| D552,172 | S | | 10/2007 | Mershon | |
| D553,354 | S | | 10/2007 | Kohler et al. | |
| D579,976 | S | | 11/2008 | Lorenzati | |
| D586,833 | S | | 2/2009 | Huang et al. | |
| D587,158 | S | | 2/2009 | Trapani et al. | |
| 7,578,257 | B1 | * | 8/2009 | Capamaggio et al. | 116/237 |
| D605,934 | S | | 12/2009 | Mirer et al. | |
| D616,296 | S | | 5/2010 | Britt et al. | |
| D624,587 | S | * | 9/2010 | Robbins | D19/34 |
| D624,588 | S | * | 9/2010 | Robbins | D19/34 |
| D624,589 | S | * | 9/2010 | Robbins | D19/34 |
| D624,590 | S | * | 9/2010 | Robbins | D19/34 |
| D624,844 | S | | 10/2010 | So | |
| D624,845 | S | | 10/2010 | Shah | |
| D629,844 | S | * | 12/2010 | Robbins | D19/34 |
| D629,845 | S | * | 12/2010 | Robbins | D19/34 |
| D632,331 | S | * | 2/2011 | Robbins | D19/34 |
| D634,363 | S | * | 3/2011 | Robbins | D19/34 |
| 8,307,777 | B2 | * | 11/2012 | Robbins | 116/237 |
| 2002/0096103 | A1 | | 7/2002 | Capstran | |
| 2002/0166497 | A1 | | 11/2002 | Rae | |
| 2004/0045496 | A1 | | 3/2004 | Smith | |
| 2004/0129198 | A1 | | 7/2004 | Wu | |
| 2006/0101621 | A1 | | 5/2006 | Just | |
| 2009/0115183 | A1 | | 5/2009 | Kim | |
| 2011/0239929 | A1 | | 10/2011 | Robbins | |
| 2011/0241330 | A1 | * | 10/2011 | Robbins | 281/42 |
| 2013/0025530 | A1 | | 1/2013 | Robbins et al. | |

FOREIGN PATENT DOCUMENTS

| | | | | | |
|---|---|---|---|---|---|
| EP | 338733 | A2 | * | 10/1989 | B42D 9/00 |
| FR | 2774028 | | | 7/1999 | |
| GB | 24930 | | | 6/1910 | |
| GB | 220401 | | | 8/1924 | |
| GB | 2150077 | A | * | 6/1985 | B42D 9/00 |
| GB | 2348851 | | | 10/2000 | |
| JP | 08216559 | | | 8/1996 | |
| JP | 08216560 | A | * | 8/1996 | B42D 9/00 |
| JP | 2004202809 | | | 7/2004 | |
| JP | 2010017970 | | | 1/2010 | |
| KR | 2010011166 | U | * | 11/2010 | B42D 9/00 |

* cited by examiner

BOOKMARKS INCLUDING COUPLING FEATURES AND RELATED METHODS

TECHNICAL FIELD

The present disclosure relates to bookmarks.

BRIEF DESCRIPTION OF THE DRAWINGS

The written disclosure describes illustrative embodiments that are non-limiting and non-exhaustive. Reference is made to certain of such illustrative embodiments that are depicted in the figures, in which.

DETAILED DESCRIPTION

Various embodiments of bookmarks are disclosed herein that provide advantages over known bookmark designs. Some embodiments of the bookmarks are well-suited for attachment to a cover flap of a book (e.g., the cover of a hardback or paperback book), while other or further embodiments are well-suited for insertion into a spine of a book (e.g., the spine of a hardback book). In some embodiments, a ribbon can be attached to a base portion of a bookmark without using adhesives or other attachment mechanisms (e.g., the ribbon may be held in place by friction alone). In some embodiments, a base portion of a bookmark includes a coupling assist feature, which can aid in coupling the bookmark to the cover of a book. In other or further embodiments, the bookmark can be well-suited for coupling with either paperback or hardback books. Other or further advantages are also possible, as will be appreciated from the drawings and discussion. The features described with respect to the various embodiments may be combined in any suitable fashion.

Embodiments of bookmarks disclosed herein can include both a base portion, which is configured to be coupled with the book in some fashion, and a ribbon portion, which is attached to the base and includes one or more free end portions that can be inserted between pages of the book as a placeholder. The base portions of the bookmarks may be coupled with a variety of books in various fashions. For example, certain embodiments of bookmarks include a rigid body that can be inserted into the spine of a book, and an end of the ribbon can extend outwardly away from the spine (see, e.g., FIG. 6). In other or further embodiments, the base portion of the bookmark may be inserted behind a cover flap (e.g., front or back cover flap) of the book, which may be of either a paperback or hardback variety (see, e.g., FIGS. 14A-14B and 16A-16D).

Certain embodiments of the base portions include attachment features that allow for quick and easy attachment of the ribbons to the base. In some arrangements, the ribbons can be attached to the base portions without using adhesives or other attachment mechanisms, such as staples, clips, etc. Such arrangements can facilitate assembly of the bookmarks, speed up assembly of the bookmarks, and/or reduce material costs associated with assembly of the bookmarks. Other advantages of various embodiments of the bookmarks will be evident from the discussion that follows.

Figure 1B:
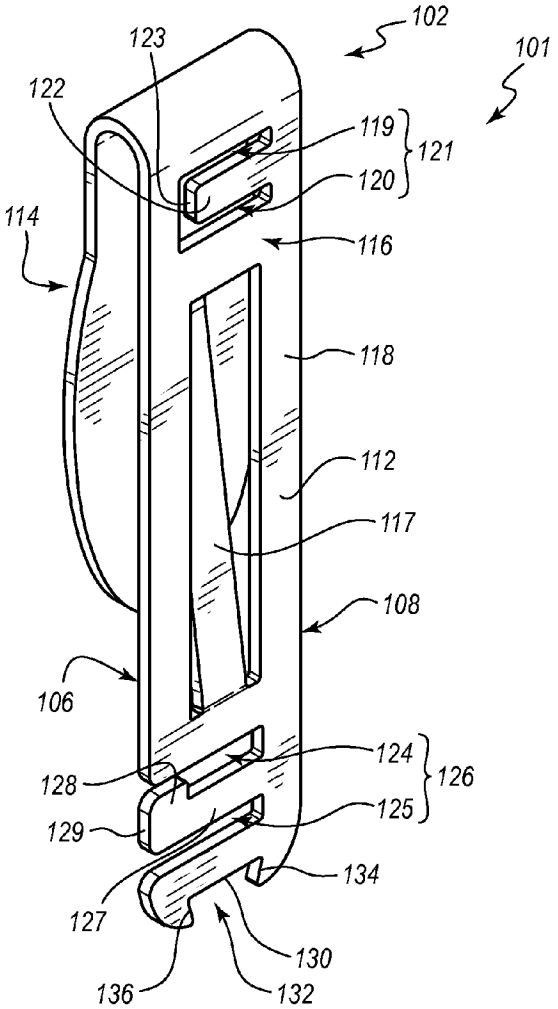
FIG. 1B is a rear perspective view of the bookmark base of FIG. 1A.
Figure 1A:
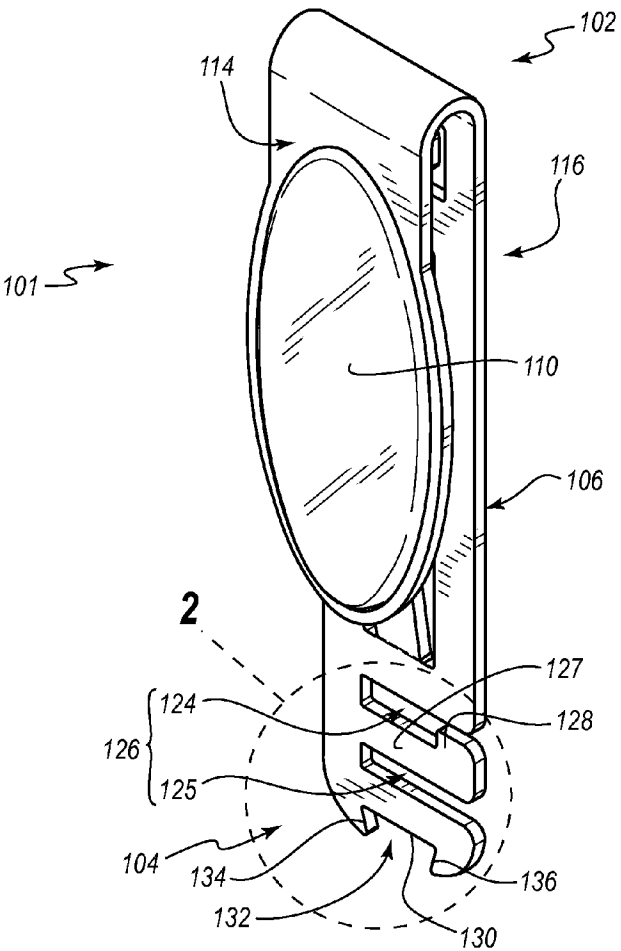
FIG. 1A is a front perspective view of an embodiment of a bookmark base.
Figure 2:
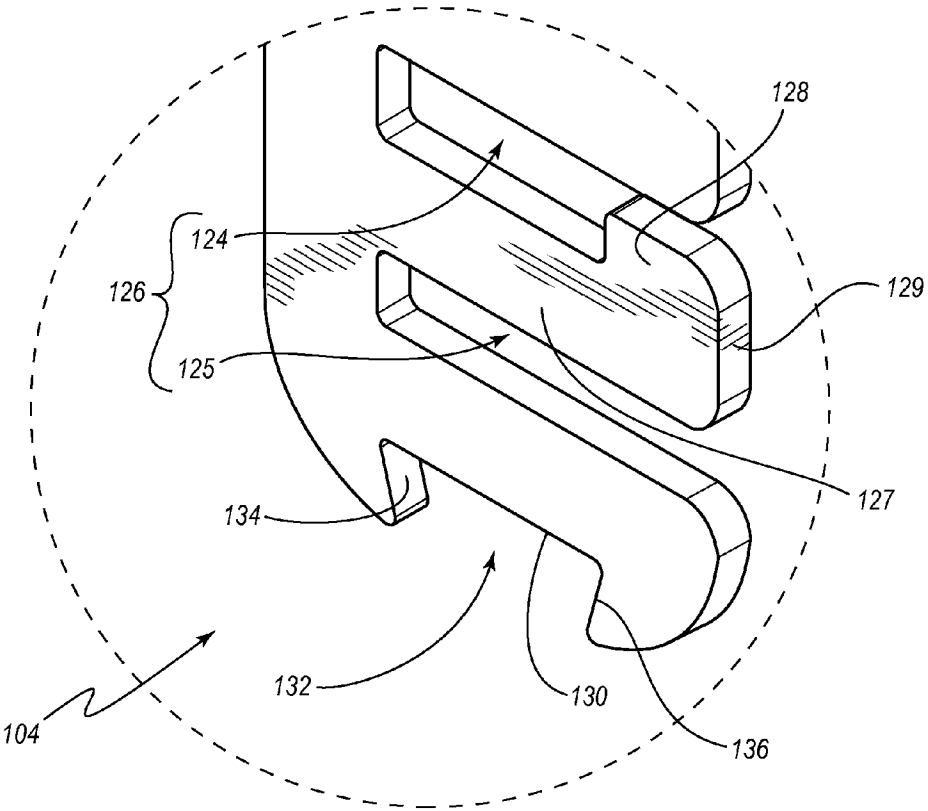
FIG. 2 is an enlarged view of a lower portion of the bookmark base of FIGS. 1A and 1B taken along the view line 2 in FIG. 1A.
Figure 1C:
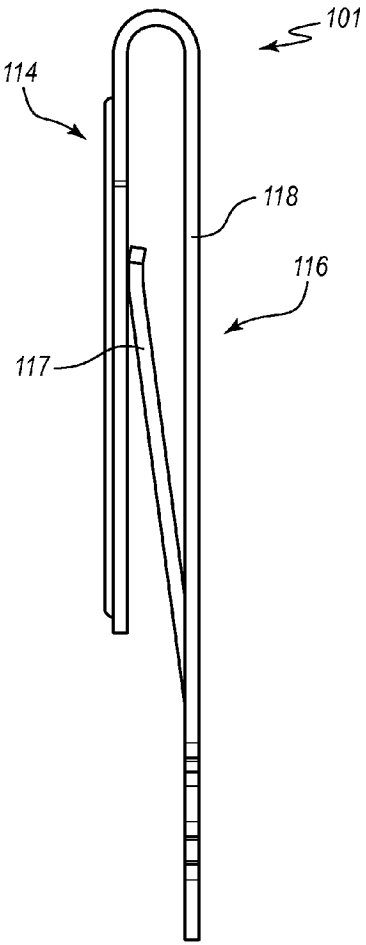
FIG. 1C is a side elevation view of the bookmark base of FIG. 1A.
Figure 3B:
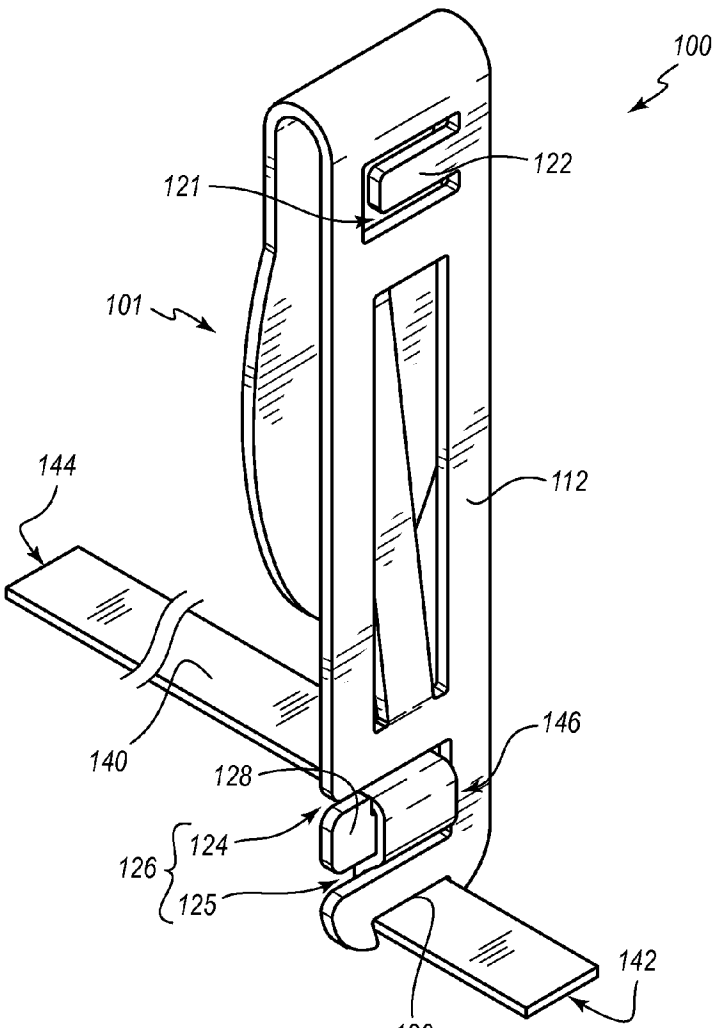
FIG. 3B is a rear perspective view of that which is shown in FIG. 3A.
Figure 3A:
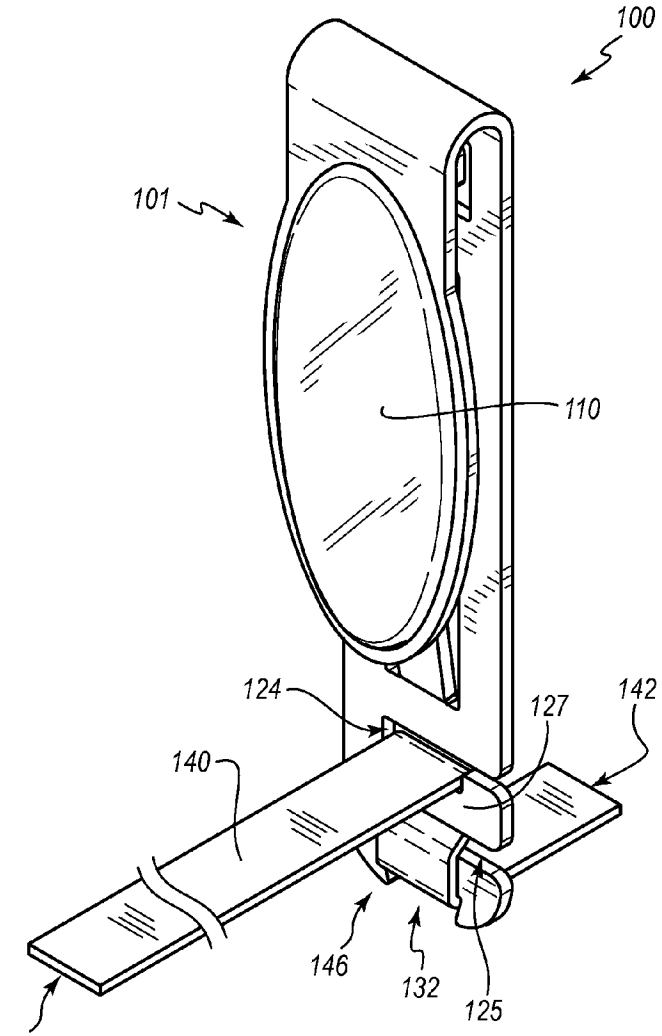
FIG. 3A is a front perspective view of the bookmark base of FIG. 1A illustrating an early stage of coupling an embodiment of a ribbon with the bookmark base so as to form a bookmark.

FIGS. 1A-6 illustrate an embodiment of a bookmark 100 that includes a base 101 (see, e.g., FIGS. 1A and 1B) and a ribbon 140 (see, e.g., FIGS. 3A and 3B). Details of the base 100 are discussed with respect to FIGS. 1A-2, and various stages of a method for attaching the ribbon 140 to the base 101 are discussed with respect to FIGS. 3A-5B. A manner in which an illustrative example of an assembled bookmark 100 can be coupled with a book 50 is discussed with respect to FIG. 6. In the following discussion, directional terms are used in their ordinary sense when the bookmark 100 is oriented as it normally would be when coupled to a book (e.g., the book 50) and viewed from an exterior of the book. For example, in FIG. 6, the "front" portion of the bookmark 100 is visible, whereas a "rear" portion of the bookmark is inserted in a spine portion 54 of the book 50 and is hidden from view. An upper end of the bookmark 100 is at a top edge of the book 50. Although innovative features may be present with respect to the specific orientations thus described, such directional terms and orientations are not necessarily limiting with respect to the design or use of some bookmarks 100. For example, in some cases, a bookmark 100 may be inserted into a spine of the book 50 at a lower end of the book 50, such that the "upper end" of the bookmark 100 may be at a lower edge of the book 50 when in use.

With reference to FIGS. 1A and 1B, the base 101 defines an upper end 102, a lower end 104, a front face 110, and a rear face 112. The base 101 includes a display body 114 that is coupled with a rigid body 116. The display body 114 can be configured for viewing once the bookmark 100 is coupled with the book 50 (see FIG. 6). Accordingly, in some embodiments, the display body 114 may bear a design, decoration, or other feature having aesthetic, artistic, or other appeal. The design or other such feature may, for example, be included on a plate, sticker, or other item that is initially separate from the display body 114 and is attached to the display body 114 in any suitable fashion (e.g., adhesives or welding), be directly applied to the display body 114 (e.g., painted on), or be integral to or removed from the display body 114 (e.g., raised features, stamped features, cutouts, or etchings).

In the illustrated embodiment, the display body 114 and the rigid body 116 are integrally formed with each other and are connected via a rounded or curved region at the upper end 102 of the base 101. The rigid body 116 extends longitudinally between the upper and lower ends 102, 104 of the base 101. The rigid body 116 further extends laterally between a left edge 108 and a right edge 106. The rigid body 116 may be formed of any suitable material, and may be configured to be positioned within a spine of a book or otherwise be positioned behind the cover of a book. The term "rigid" is not intended to be limiting, and can include substantially rigid or semi-rigid materials that are able to substantially maintain their form under minor stresses and/or readily remove to an initial state after minor deformations. For example, in various embodiments, the rigid body 116 (and/or other portions of the base 101) may be formed of a metal or plastic.

The rigid body 116 can include a spring member 117 that projects forwardly from a rear portion 118 of the rigid body 116. The spring member 117 thus can extend toward a rearward side of the display body 114. The spring member 117 can be resiliently deformable, such that a biasing force may arise within the spring member 117 upon displacement thereof relative to the rear portion 118 of the rigid body 116. The spring member 117 can be configured to provide a biasing force in a forward direction when a portion of a cover 52 of the book 50 is inserted between the rigid body 116 and the display body 114 so as to compress the spring member 117, as discussed further below with respect to FIG. 6. In the illustrated embodiment, and as is common for many varieties of books, the cover 52 of the book 50 can include both a front and a back cover flap 56, 58. Moreover, the cover 52 can extend between the front cover flap 56 to the back cover flap 58 so as to define an outer portion of a spine 54 of the book 50.

The base 101 can be configured to couple with the ribbon 140, as discussed further with respect to FIGS. 3A-5B. With continued reference to FIGS. 1A-1B, the rigid body 116 portion of the base 101 may include a number of elongate protrusions, anchor members, lateral projections, tabs, grips, or shelf members 122, 127 about which the ribbon 140 may be threaded or otherwise positioned or secured. Each shelf member 122, 127 may respectively be bordered by one or more openings 119, 120, 121, 124, 125, 126 through which the ribbon 140 may pass to facilitate the coupling of the ribbon 140 to the base 101.

In the illustrated embodiment, a first shelf member 122 is positioned at or near the upper end 102 of the base 101. An opening 121 extends about three sides of the first shelf member 122. The opening 121 includes a first opening 119 that borders an upper side of the shelf member 122 and a second opening 120 that borders a lower side of the shelf member. The opening 121 further proceeds about a free end 123 of the shelf member 122. It may be said that the shelf member 122 is disposed within the opening 121. The shelf member 122 may extend laterally across a portion of the rigid body 116. In the illustrated embodiment, the shelf member 122 extends laterally from left to right, but it is understood that the shelf member 122 can extend laterally from right to left in other embodiments. The shelf member 122 can be flush with surrounding portions of the rigid body 116. For example, in the illustrated embodiment, the rear face 112 of the rigid body 116 is substantially planar, and a rear face of the shelf member 122 may be in the same plane as the rear face 112 of surrounding portions of the base 101. The shelf member 122 may be formed from the same material as the rigid body 116 of the bookmark. For example, in some embodiments, the opening 121 may comprise a stamped- or punched-out, etched, or other such region at which a portion of the material of which the shelf member 122 and the rigid body 116 are formed has been removed.

Another shelf member 127 can be positioned at the lower end 104 of the rigid body 116. The shelf member 127 can be in the same plane as the rear portion 116 of the body and can be disposed laterally along the body. In the illustrated embodiment, the shelf member 127 is disposed in a lower opening 126 of the rigid body 116. The illustrated shelf member 127 extends from left to right in the lateral direction. As with the shelf member 122, the shelf member 127 can also be disposed from right to left in the lateral direction, in other embodiments. Moreover, the shelf member 122 and the shelf member 127 may extend in the same direction laterally (i.e. both from left to right, as illustrated, or both from right to left) or in opposite lateral directions (i.e. one from left to right and the other from right to left). Further, the shelf member 127 may be disposed substantially parallel to the shelf member 122.

As illustrated in FIGS. 1A and 1B the upper opening 121 fully extends about three sides of the shelf member 122. In contrast, the lower opening 126 extends about only two sides of the shelf member 127. In particular, the lower opening 126 includes a first opening 124 that borders an upper side of the shelf member 127 and includes a second opening 125 that borders a lower side of the shelf member 127. Accordingly, a free end 129 of the shelf member 127 is not bordered by the opening 126 that is defined in the rigid member 116. Rather, the free end 129 is substantially flush with the right edge 106 of the rigid member 116.

Stated otherwise, the upper opening 121 is fully enclosed, encircled, or encompassed by the rigid member 116. Likewise, the free end 123 of the upper shelf member 122 is fully enclosed, encircled, or encompassed by neighboring portions of the rigid member 116. In contrast, the lower opening 126 and the lower shelf member 127 are not fully encompassed by neighboring portions of the rigid member 116, such that the lower shelf member 127 is directly accessible from the right side of the rigid body 116.

It will be appreciated that the upper opening 120 could extend completely to one edge of the rigid body 116 (as the lower opening 126 does). In other or further embodiments, the lower opening 126 could be completely enclosed (as the upper opening 121 is). Where a free end 123, 129 is exposed (such as the free end 129 in the illustrated embodiment), it should be understood that the free end 123, 129 could be at either side of the rigid body 116. The terms "distal" and "proximal" may be used herein to refer to portions of the upper and lower shelf members 122, 127. As used herein, the term proximal refers to the end of the shelf member 122, 127 that is coupled to the rigid body 116, and the distal end comprises the free ends 123, 129 of the shelf members 122, 127, respectively. It may be said that the shelf members 122, 127 project from an interior portion of the rigid body 116 and terminate at the free ends 123, 129, or stated otherwise, project from the rigid body 116 in a distal direction.

With reference to FIG. 2, which is a detail front perspective view of the lower edge of the bookmark of FIG. 1A, the shelf member 127 includes a retaining shoulder 128 located at its distal end. The retaining shoulder 128 is configured to restrain lateral movement of the ribbon 140 after it has been looped around the shelf member 127. In various embodiments, one, both, or neither of the shelf members 122, 127 can include a retaining shoulder.

With continued reference to FIG. 2, the rigid body 116 can include a notch 130 positioned in its lower end 104. The notch 130 can define a recess 132 that is sized and shaped to receive a portion of the ribbon 140 therein and to restrain lateral movement of the ribbon 140. The notch 130 can include angled sidewalls 134, 136 that may assist in maintaining the ribbon 140 within the recess 132. For example, in the illustrated embodiment, the sidewalls 134, 136 angle inwardly in a downward direction such that greater space within the recess 132 is available at an upper end of the recess 132 than at a lower end thereof. In other embodiments, the sidewalls 134, 136 may be substantially parallel to each other, or may angle outwardly in a downward direction.

The shelf members 122, 127, the openings 121, 126, and the notch 130 may be utilized in coupling a ribbon 140 to the base 101. Although an adhesive may optionally be used in coupling the ribbon 140 to the base 101, the foregoing structures may cooperate such that the coupling can occur without the use of adhesive or any other supplemental securing mechanism (e.g., staples, clips, etc.). Where an adhesive is used, the ribbon 140 could be adhered to the base 101 directly via the adhesive, or it may be looped around a portion of the base 101 and then attached to itself via the adhesive. In situations where no adhesive is used, such as those discussed below with respect to certain illustrative methods, the ribbon 140 may be threaded through and around, or otherwise advanced about, the shelf members 122, 127 in such a manner as to hold the ribbon 140 in place via friction. Such frictional engagement or frictional attachment may be completed in such a manner as to maintain the ribbon substantially flat along its length. Such flattened arrangements can allow for a more compact or lower profile design than other possible arrangements, such as arrangements in which a knot may be tied in the ribbon 140 so as to secure the ribbon to the base 101.

FIGS. 3A to 5B depict various stages of an illustrative method for coupling the ribbon 140 to the base 101. It will be understood that other suitable methods also exist for coupling the ribbon 140 to the base 101 such that the ribbon 140 is maintained in place through frictional engagement.

FIGS. 3A and 3B illustrate an early stage of coupling the ribbon 140 to the base 101. The ribbon 140 has a proximal end 142 and a distal end 144. In the illustrated method, the proximal end 142 of the ribbon 140 is the end that is closest to the base 101 when the ribbon 140 is completely coupled to the base 101 (see FIG. 5B), whereas the distal end 144 is the free end that extends away from the base 101 and may be used as a placeholder in the book 50 (see FIG. 6). It should be understood, however, that such terminology is used for convenience in describing the present example, but is not limiting. For example, as discussed below, in some embodiments, once the ribbon 140 has been coupled with the base 101, the proximal end 142 also extends away from the base 101, such that each of the proximal end 142 and the distal end 144 of the ribbon 140 may be used as placeholders in the book 50.

The ribbon 140 can include an intermediate segment 146 that is at any suitable position between the proximal and distal ends 142, 144. Depending on the methodology used for coupling the ribbon 140 to the base, the intermediate segment 146 may be closer to one of the ends 142, 144 than the other, or may be spaced substantially equally from each end 142, 144. The intermediate segment 146 includes the portion of the ribbon 140 that interacts with the lower shelf member 127, which can assist in maintaining the ribbon 140 in a secure attachment to the base 101.

With continued reference to FIGS. 3A and 3B, in an early stage of coupling, the proximal end 142 of the ribbon may be threaded in a rearward direction through the opening 124 that is above the shelf member 127. The proximal end 142 of the ribbon 140 may then be doubled back and threaded in a forward direction through the opening 125 that is below the shelf member 127 so as to bring the intermediate segment 146 of the ribbon 140 into contact with the lower shelf member 127. The proximal end 142 of the ribbon 140 may then be wrapped about the lower end 104 of the base 101 in a rearward direction so that a portion of the ribbon 140 is received within the recess 132 of the notch 130.

Figure 4B:
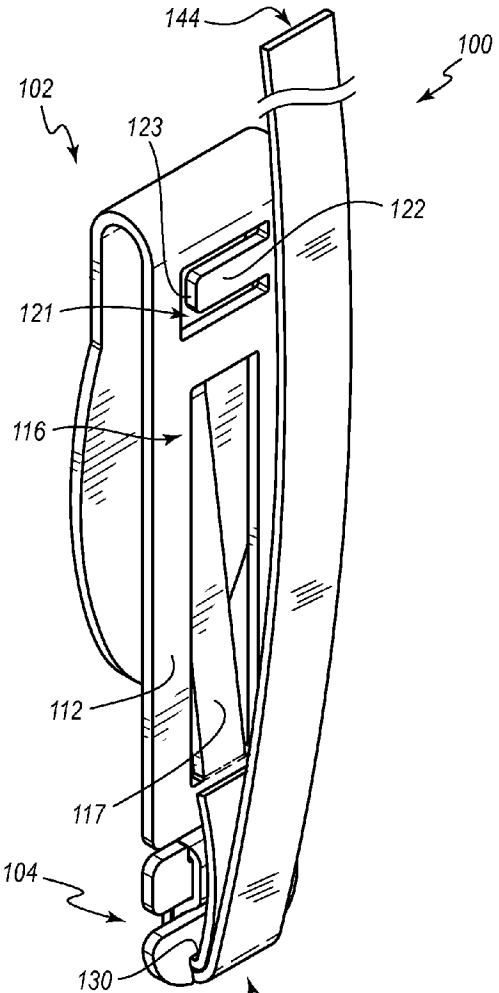
FIG. 4B is a rear perspective view of that which is shown in FIG. 4A.
Figure 4A:
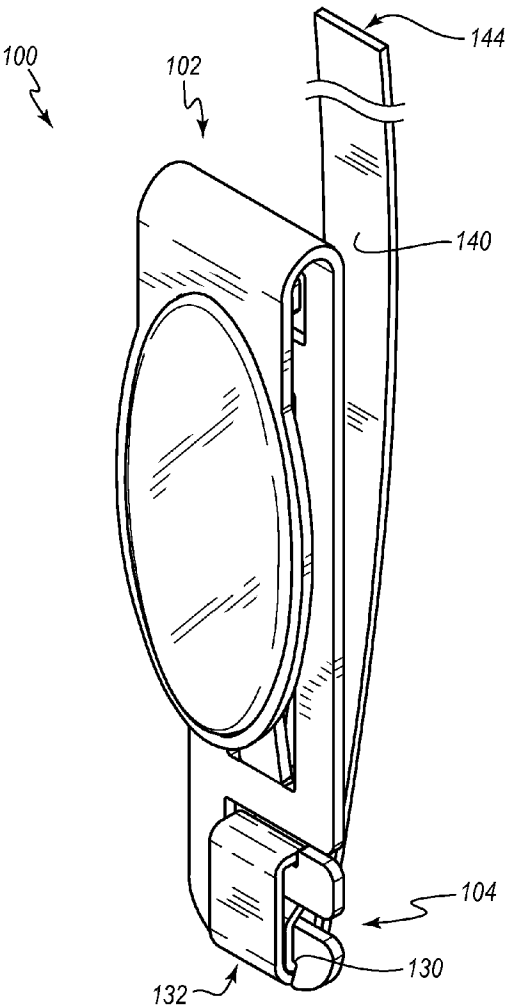
FIG. 4A is a front perspective view of the bookmark base of FIG. 1A illustrating a later stage of coupling the ribbon with the bookmark base.

With reference to FIGS. 4A and 4B, in another stage of coupling the ribbon 140 to the base 101, the proximal end 142 of the ribbon 142 is disposed against the back face 112 of the rigid body 116. A proximal length of the ribbon 142 (e.g., a portion of the ribbon 140 that is between the intermediate segment 146 and the proximal end 142) thus may extend along the back face 112 in a longitudinal direction from the lower end 104 toward the upper end 102. In some arrangements, the proximal end 142 of the ribbon 140 may only extend partially along a the length of the rigid body 116. For example, in the illustrated embodiment, the proximal end 142 of the ribbon 140 is positioned at a bottom end of the spring member 117 (see FIG. 4B).

With continued reference to FIGS. 4A and 4B, the distal end 144 of the ribbon 140 may also be wrapped about the lower end 104 of the base 101 in a rearward direction so as to be received within the recess 132 of the notch 130. The distal end 144 likewise can extend along the back face 112 of the base 101, as discussed further below.

Figure 5B:
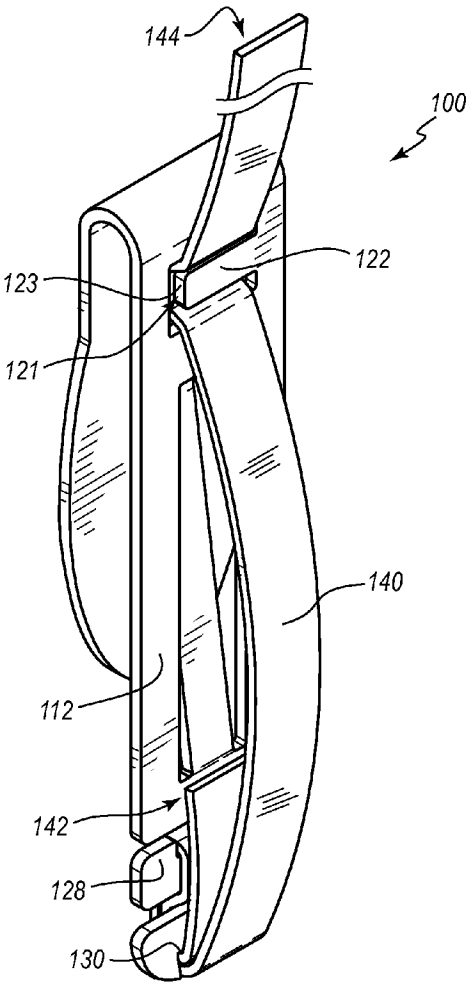
FIG. 5B is a rear perspective view of that which is shown in FIG. 5A.
Figure 5A:
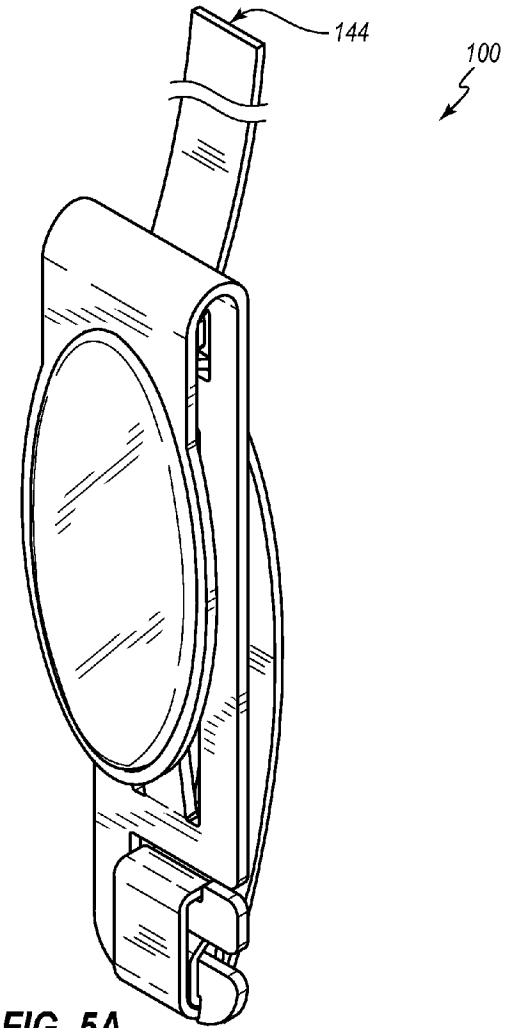
FIG. 5A is a front perspective view of the bookmark base of FIG. 1A illustrating a later stage of coupling the ribbon with the bookmark base.

With reference to FIGS. 5A and 5B, in another stage of coupling the ribbon 140 to the base 101, the distal portion of the ribbon 140 may be inserted into the opening 121 so as to engage the ribbon 140 with the upper shelf member 122. In some instances, the distal end 144 of the ribbon 140 may be threaded into the portion of the opening 121 that is below the shelf member 122 and then threaded back out through the portion of the opening 121 that is above upper shelf member 122. In other instances, the ribbon 140 is forced into the portion of the opening 121 that borders the free end 123 of the upper shelf member 122. For example, a side edge of the ribbon 140 may be inserted into the opening 121, and the ribbon 140 may be advanced in a lateral direction into the position depicted in FIG. 5B in which ribbon 140 is frictionally engaged with upper and lower front edges of the upper shelf member 122.

In some instances, after the ribbon 140 has been positioned in the opening 121 about the upper shelf member 122 (e.g., after having been brought to the orientation shown in FIG. 5B), the distal end 144 of the ribbon 140 may be pulled taut so as to remove slack from the ribbon 140 and thus bring the upper portion of the ribbon 140 into close proximity to the rear face 112 of the base 101. In such a configuration, friction between surfaces of the ribbon 140 that are in contact with the base 101 and between surfaces of the ribbon 140 that are in contact with each other may secure the ribbon 140 to the base 101 in a substantially secure fashion. Moreover, the retaining shoulder 128 and the notch 130 may restrain the ribbon 140 so as to inhibit or prevent lateral displacement. Restraining movement of the ribbon 140 in this manner can serve to maintaining contact between the ribbon 140 and the base 101 and between adjacent portions of the ribbon 140 so as to maintain sufficient frictional forces to keep the ribbon 140 secured to the base 101.

Figure 12:
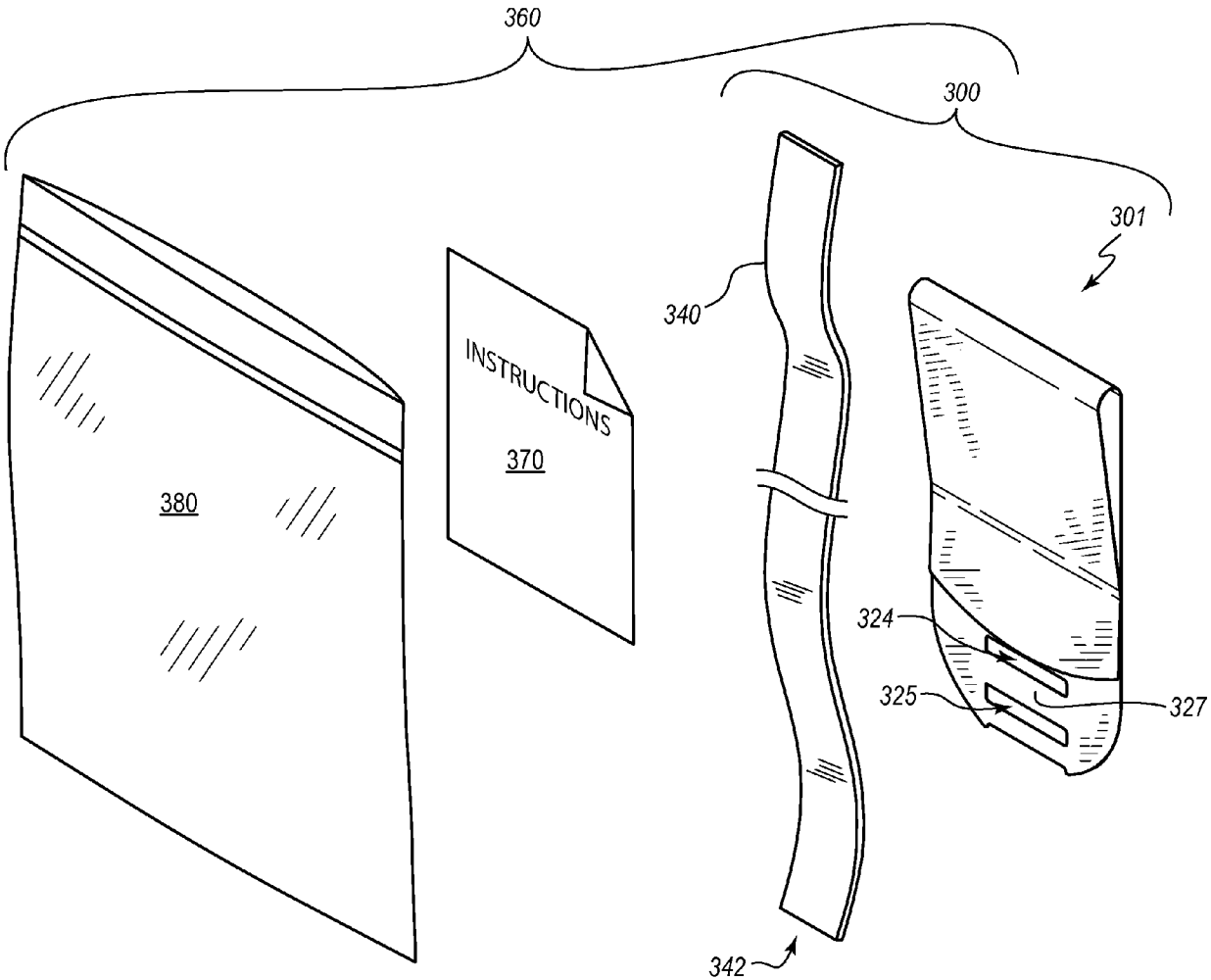
FIG. 12 is a front perspective view of an embodiment of a kit that includes another embodiment of a bookmark base.

It will be appreciated that certain procedures described above may be achieved in embodiments where the shelf member extends completely across the opening, such that the shelf does not include a free end, whether such free end is directly accessible from a side of the rigid body 116 (e.g., such as the free end 129) or is accessible from a rear of the rigid body 116 (e.g., such as the free end 123). An example of such a shelf member arrangement is shown in FIG. 12. In other words, in some embodiments, the shelf member may extend from the rigid body 116 at either end thereof, and openings above and below the shelf member can each be fully enclosed (e.g., have four sides). In particular, "threading" procedures described above can be used with shelf members that have a free end (e.g., a three-sided geometry) as well as those that do not (e.g., a two-sided open geometry).

It is further noted that other methods of assembling the bookmark 100 are also possible. Specifically, with reference to FIGS. 3A and 3B, a different procedure may be used to insert the ribbon 140 over the shelf member 127. Given the direct accessibility of the shelf member 127 from the right side of the rigid body 116, the ribbon 140 may not be "threaded" through the openings that boarder the shelf member 127. Rather, the ribbon may instead be looped, and then the looped portion of the ribbon 140 may be advanced laterally over the shelf member 127 in the right-to-left direction. Such a technique will be further appreciated in view of the discussion below with respect to FIG. 8.

Moreover, with reference to FIGS. 3A-4B, it is possible to wrap both the proximal and distal portions of the ribbon 140 about the lower end 104 of the rigid body 116 simultaneously, rather than in separate stages as shown in these drawings. In other or further embodiments, both proximal and distal portions of the ribbon 140 are inserted into the upper opening 121 so as to be retained by the upper shelf member 122. Accordingly, both the proximal end 142 and the distal end 144 of the ribbon 140 can extend away from the base 101, such that both the proximal end 142 and the distal end 144 of the ribbon 140 may be used as placeholders in the book 50. It will be understood that other suitable coupling procedures and arrangements are also possible.

Figure 6:
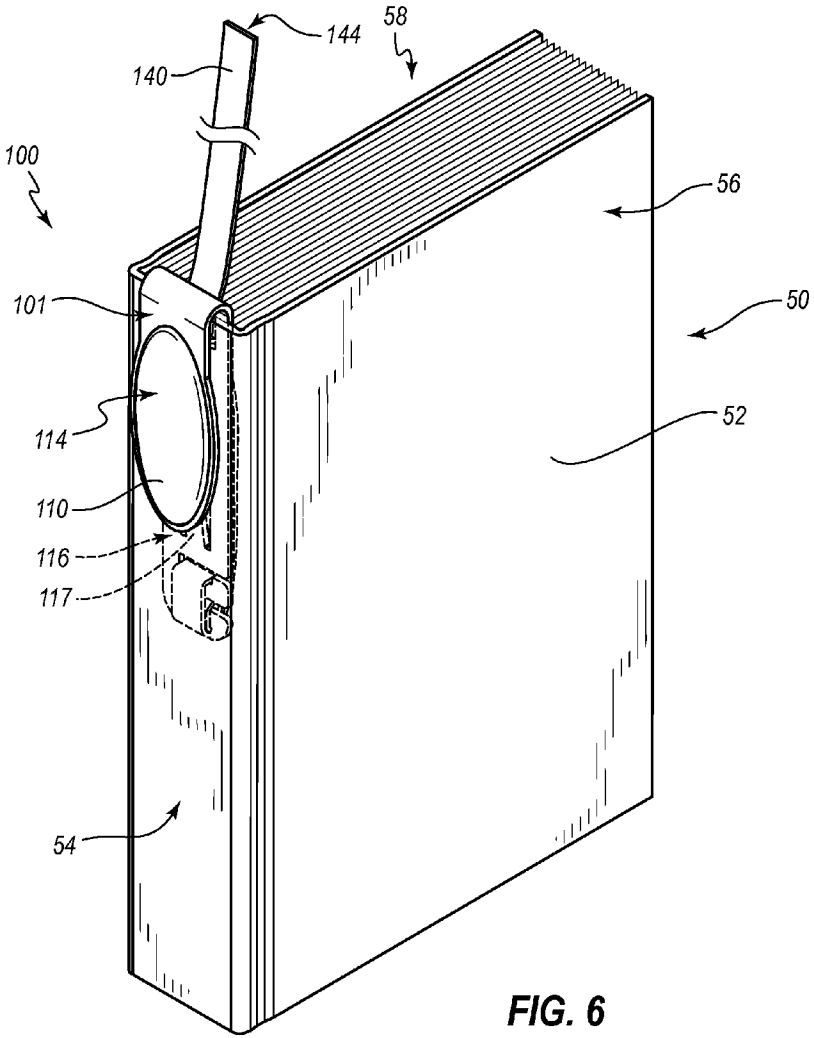
FIG. 6 is a perspective view of an embodiment of an assembled bookmark coupled with a binding region of a book.

FIG. 6 shows a bookmark base 101 coupled to a ribbon 140 and further coupled to a book 50. The bookmark base 101 may be coupled to the spine 54 of the book 50, as illustrated, or it may be attached to other regions of the book 50 (such as the front cover). In the illustrated configuration, the ribbon 140 can be selectively draped over any desired number of the pages of the book 50 and extended between adjacent pages so as to serve as a placeholder. The display body 114 is at an exterior of a cover 52 of the book 50, and the rigid body 116 is at an interior of the cover 52 of the book 50. The cover 52 thus extends between the display body 114 and the rigid body 116 so as to compress the spring member 117, which can assist in maintaining the base portion 101 of the bookmark 100 secured to the cover 52.

FIGS. 7-11 illustrate another embodiment of a bookmark 200, which can resemble the bookmark 100 described above in certain respects. Accordingly, like features are designated with like reference numerals, with the leading digits incremented to "2." Relevant disclosure set forth above regarding similarly identified features thus may not be repeated hereafter. Moreover, specific features of the bookmark 200 may not be shown or identified by a reference numeral in the drawings or specifically discussed in the written description that follows. However, such features may clearly be the same, or substantially the same, as features depicted in other embodiments and/or described with respect to such embodiments. Accordingly, the relevant descriptions of such features apply equally to the features of the bookmark 200. Any suitable combination of the features and variations of the same described with respect to the bookmark 100 can be employed with the bookmark 200, and vice versa. This pattern of disclosure applies equally to further embodiments depicted in subsequent figures and described hereafter.

Figure 7:
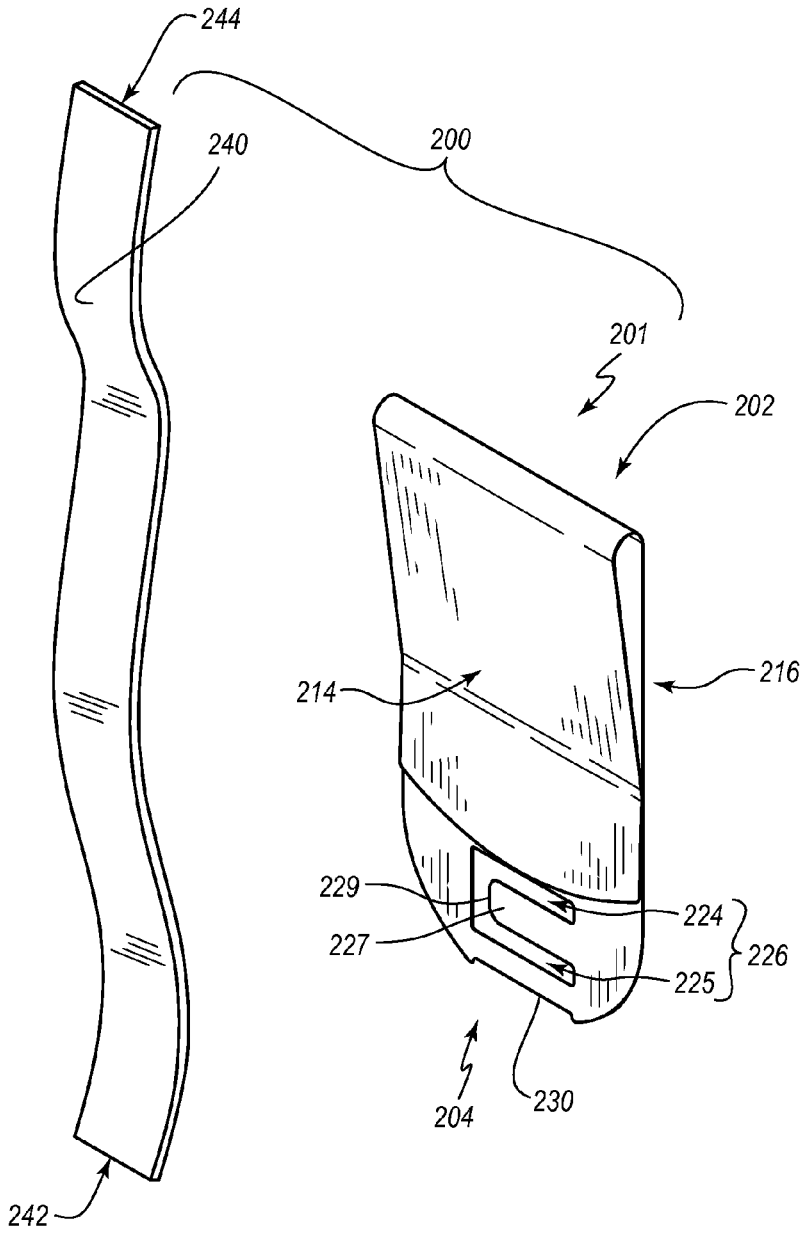
FIG. 7 is a front perspective view of another embodiment of a bookmark base and an embodiments of a ribbon that can be coupled with each other so as to form a bookmark.

With reference to FIG. 7, the bookmark 200 includes a base 201 and a ribbon 240. The base 201 includes a display body 214 and a rigid body 216. As with the display body 114, the display body 214 can be configured to be positioned at an exterior of a book 50 when the bookmark 200 is coupled thereto such that the display body 214 is viewable. The display body 214 thus may bear a design, decoration, or other feature. The rigid body 216 can be coupled with the display body 214 and can be configured to cooperate therewith to maintain the bookmark 200 coupled with a book 50. The manner in which the rigid body 216 and the display body 214 cooperate with each other can vary from the cooperation between the rigid body 116 and the display body 114 discussed above.

As with the rigid body 116 and the display body 114, the rigid body 216 and the display body 214 can be connected to each other by an extension at an upper end 202 of the base 201. The extension is rounded in the illustrated embodiment, but other configurations are also possible. The rounded extension can act as a spring such that a lower portion of the display body 214 is biased rearwardly toward the rigid body 216. The display body 214 and the rigid body 216 thus can act as a clip.

The rigid body 216 can be semi-rigid or substantially rigid, as discussed with respect to the rigid body 216. The rigid body 216 likewise may be elongated between the upper end 202 and a lower end 204 of the base 201. The rigid body 216 may be wider, relative to the display body 214, than is the rigid body 116 relative to the display body 114. In some arrangements, the rigid body 216 may be wider than a thickness of a book 50, such that the rigid body 216 may not be practicable for use with the binding of the book 50, and may instead be positioned behind a flap or cover (front or back) of the book 50.

In the illustrated embodiment, the rigid body 216 of the base 201 includes a lower opening 226 and a shelf member 227. An upper portion 224 of the lower opening 226 is at an upper edge of the shelf member 227 and a lower portion 225 of the opening 226 is at a lower edge of the shelf member 227. Whereas the lower opening 126 of the base 101 described above extends completely to one side of the base 101, the lower opening 226 of the base 201 extends only partially across a width of the rigid body 216. Thus, the lower opening 226 is completely enclosed, surrounded, encircled, or encompassed by neighboring portions of the rigid body 216. It will be appreciated that the rigid body 216 could instead include an opening that extends completely to one side of rigid body 216 (as in FIG. 1A). Similarly, the rigid body 116 described above could instead include an opening and shelf member such the opening 226 and the shelf member 227.

Figure 10:
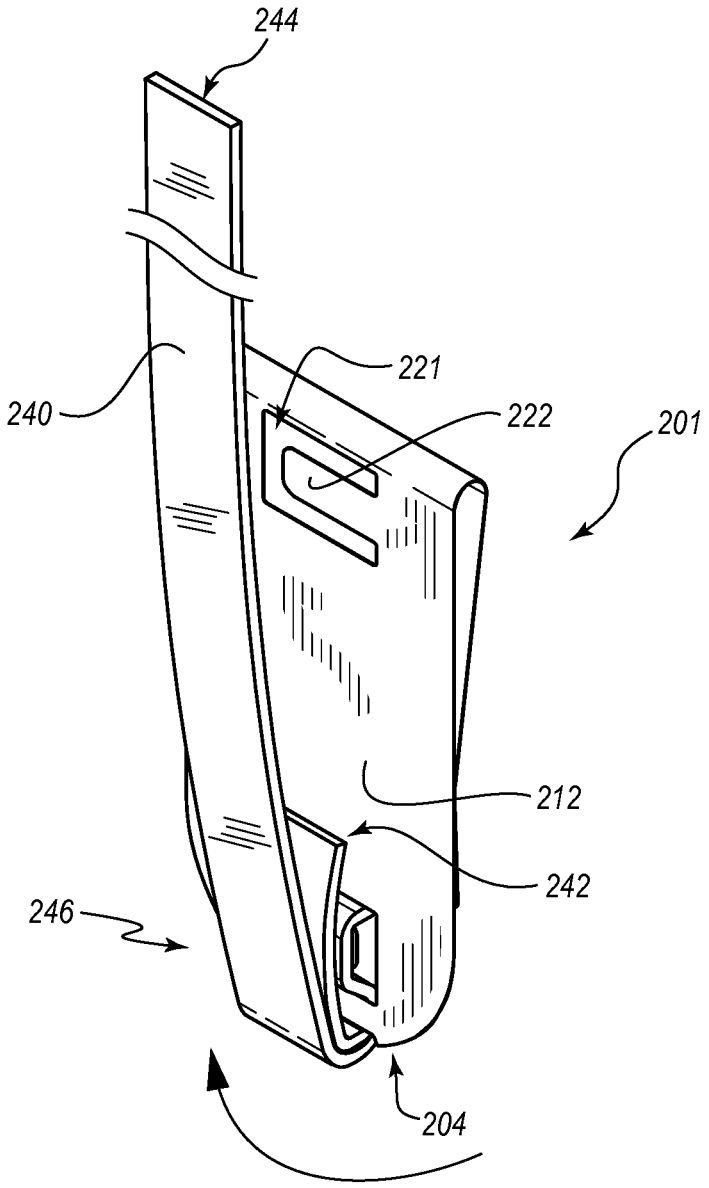
FIG. 10 is a rear perspective view of the bookmark base of FIG. 7 showing a later stage of coupling the ribbon thereto.

As shown in FIG. 10, the rigid body 216 can include an upper opening 221 and an upper shelf member 222, which can resemble the upper opening 121 and the upper shelf member 122 described above. It is noted that the upper openings 121, 221 and associated upper shelf members 122, 222 can be of a form other than that shown in FIGS. 1B and 10, respectively. For example, in some embodiments, the upper openings 121 and shelf members 122, 222 can resemble the lower opening 126 and the lower shelf member 127 described above with respect to the base 101.

With continued reference to FIG. 7, the base 201 includes a notch 230 at a lower end 204 thereof. As explained above, features of the bookmark 200 may be interchangeable with the bookmark 100 depicted above. For instance, the notch 130 of the bookmark base 101 is illustrated as having a greater depth than the notch 230 of bookmark base 201. Either configuration of the notch 130, 230 design may be compatible with either bookmark 100, 200, and other suitable arrangements are also possible. In the illustrated embodiment, the notch 230 widens in a downward direction.

Figure 8:
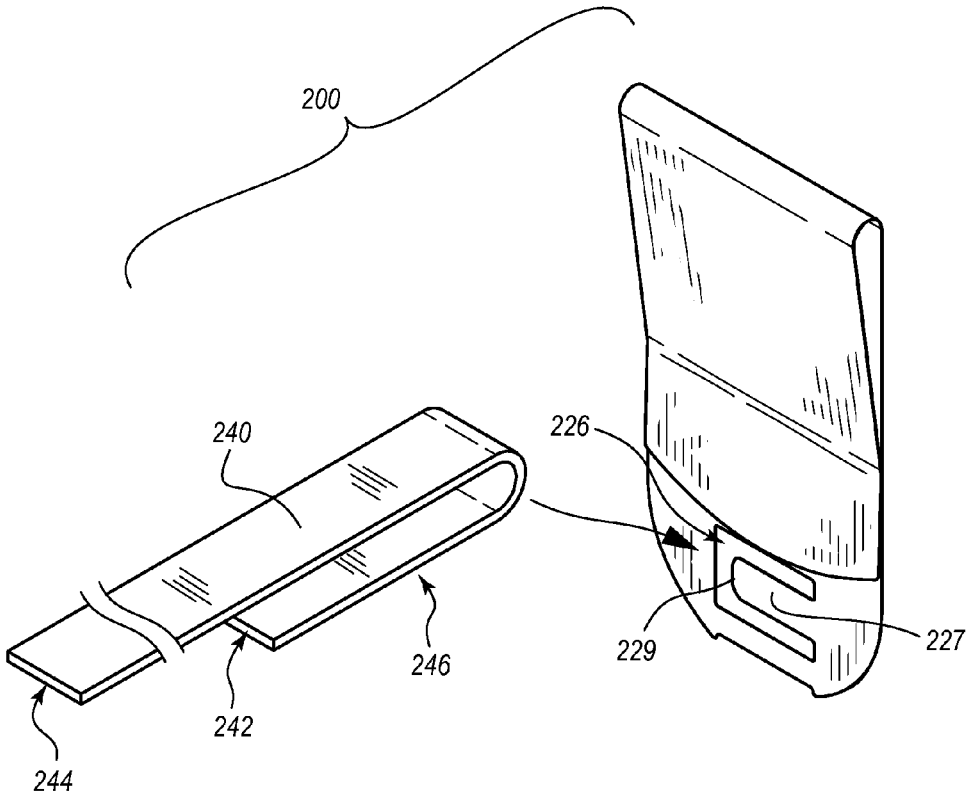
FIG. 8 is a front perspective view of the bookmark base of FIG. 7 showing an early stage of coupling the ribbon thereto.

FIG. 8 illustrates an early stage of coupling the ribbon 240 to the base 201. As illustrated, a proximal portion of the ribbon 240 may be doubled back on itself prior to its coupling with the base 201. An intermediate segment 246 of the ribbon 140, which is coupled with the lower shelf member 227, can comprise the doubled back portion. In some embodiments, the doubled back portion defines a loop. In FIG. 8, the looped end is shown in an open state, but the loop could be arranged in a closed state. For example, a user may hold both ends of the doubled back portion of the ribbon 240 between a thumb and a finger, such that both portions of the ribbon 240 contact each other and such that the ribbon 240 defines an opening into which the shelf member 227 can be received. The loop can be advanced over the shelf member 227. An edge of the loop can be advanced over a free end 229 of the shelf member 227 and into the opening 226, as depicted by a bold arrow in FIG. 8.

Figure 9:
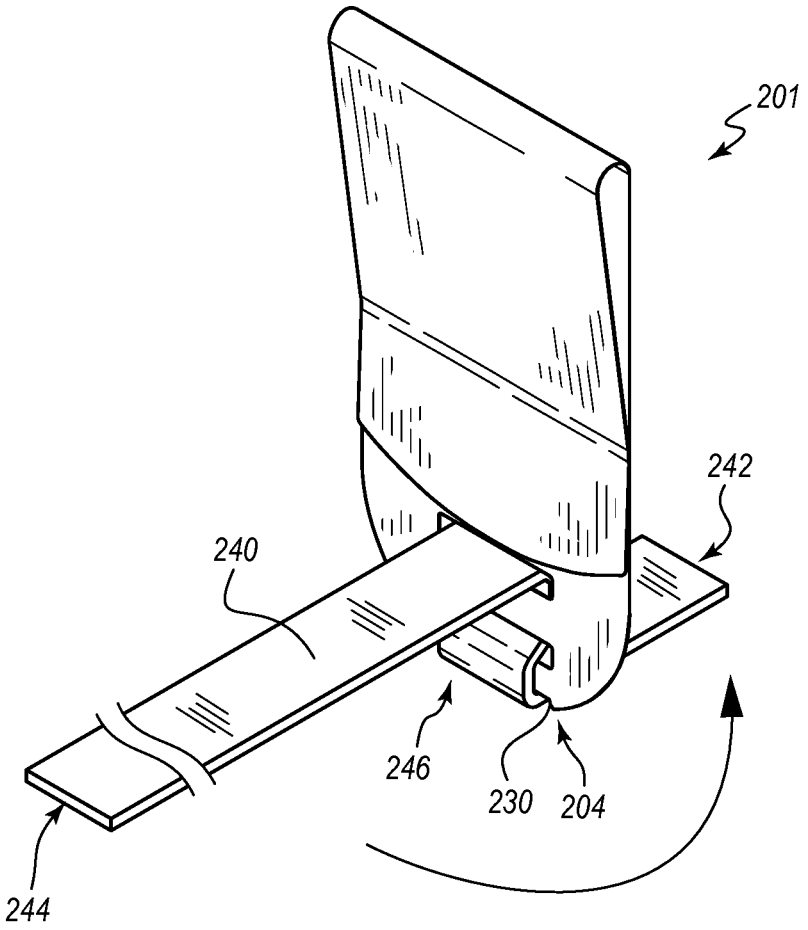
FIG. 9 is a front perspective view of the bookmark base of FIG. 7 showing a later stage of coupling the ribbon thereto.

FIG. 9 illustrates another stage of coupling the ribbon 240 to the base 201. The proximal end 242 of the ribbon 240 may be wrapped about or otherwise disposed around the lower end of the body 201 so as to be received in the notch 230, as depicted by a bold arrow.

FIG. 10 illustrates another stage of coupling the ribbon 204 to the base 201. The proximal end 242 of the ribbon may be disposed against a back face 212 of the base 201 so as to extend upwardly in a longitudinal direction along the back of the base 201. The distal end 244 of the ribbon 240 may also be wrapped about the bottom end 204 of the base 201 and may be brought into close proximity to the rear face 212 of the base 201. As described above with respect to the bookmark 100, in some instances, the proximal and distal ends 242, 244 of the ribbon 240 can be wrapped about the bottom end of the base 201 simultaneously, rather than separately as shown in FIGS. 9 and 10.

Figure 11:
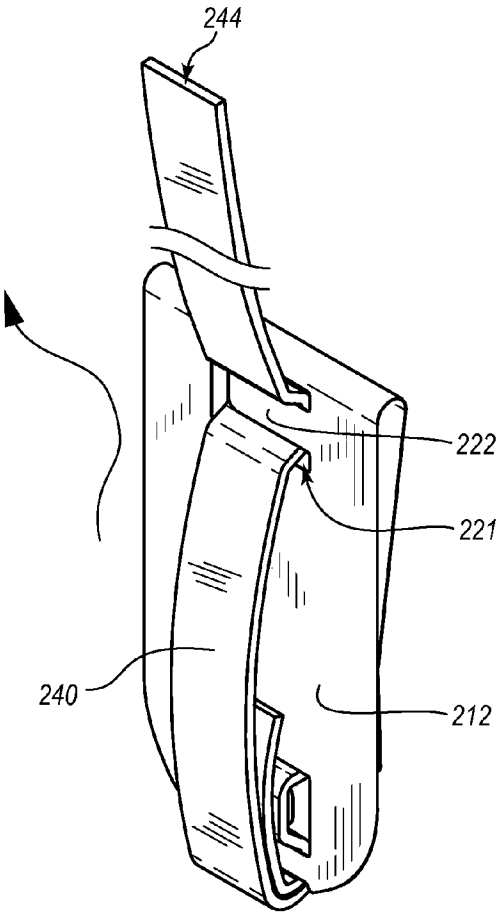
FIG. 11 is a rear perspective view of the fully assembled bookmark that includes the components of FIG. 7A.

FIG. 11 illustrates another stage of coupling the ribbon 204 to the base 201. In some embodiments, a distal portion of the ribbon 240 is advanced into a position about shelf member 222 in a manner similar to that discussed above with respect to insertion of the ribbon 240 about the shelf member 226. For example, in some embodiments, a loop may be formed from the ribbon 240 and an edge of the ribbon 240 may be advanced into the opening 221. In other instances, the edge of the ribbon 240 may be inserted into the opening 221 without first forming a loop in the ribbon 240. In still other methods, the distal end 244 of the ribbon may be threaded into the upper opening 221 below the shelf member 222 in a forward direction, then back through the upper opening 221 above the shelf member 222 in a rearward direction. After insertion of the ribbon 240 into the opening 221, the distal end 244 of the ribbon 240 may be pulled tight to remove slack in the ribbon 240, which can assist in maintaining tension or friction in the ribbon 240 at the lower end of the base 201.

FIG. 12 illustrates that an embodiment of a kit 360 that can include various components of a bookmark 300 that may come in a pre-assembled state or in a separated state. The kit 360 can include a base 301 and one or more ribbons 340. Any suitable base and ribbon may be present in the kit 360, such as any of those discussed above. In the illustrated embodiment, the base 301 includes a shelf member 327 that is different from other shelf members described above. In particular, the shelf member 327 is enclosed, circumscribed, or surrounded at either end thereof by the base 301. Stated otherwise, the shelf member 327 extends from an interior portion of the base 301 and terminates at another interior portion of the base 301. It is noted that the shelf member 327 is positioned in a rigid body portion of the base 301.

A first opening 324 can be positioned above the shelf member 327, and a second opening 325 can be positioned below the shelf member 327. Such an arrangement can be suitable for threading of a proximal end 342 of the ribbon 340 about the shelf member 327 in manners such as described above, as the shelf member 327 is accessible from the front and rear sides of the base 301, but is not directly accessible from either side edge of the base 301.

The kit 360 can further include instructions 370, which may be contained on a separate sheet or card within a packet or package 380 (e.g., a bag), along with the bookmark components, or which may, in some embodiments, be printed directly on the package 380. The instructions 370 can include directions for performing any and/or all of the steps or stages of a method for attaching the ribbon 340 to the base 301, such as any of the procedures discussed above. In other or further embodiments, the instructions 370 may provide directions for merely accessing such directions. For example, the instructions may list a web address, a mailing address, and/or a telephone number that can be used to locate instructions for assembling a bookmark.

Figure 13B:
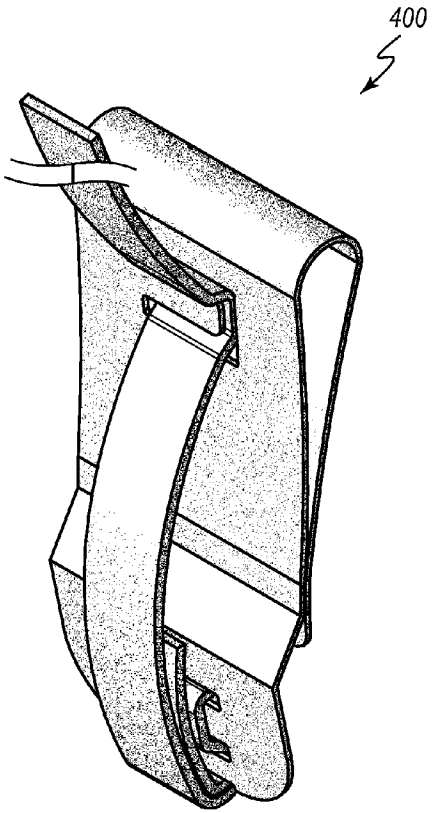
FIG. 13B is a rear perspective view of the bookmark of FIG. 13A.
Figure 13A:
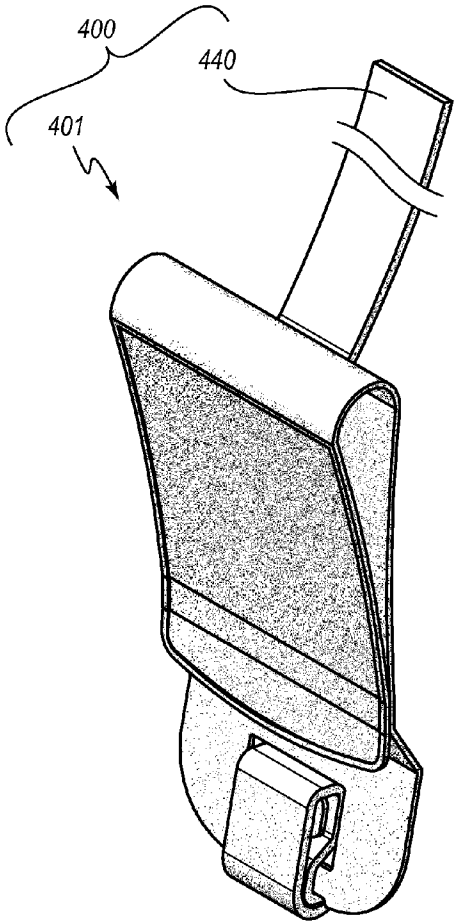
FIG. 13A is a front perspective view of another embodiment of a bookmark.

FIGS. 13A and 13B illustrate another embodiment of a bookmark 400 that includes a base 401 coupled with a ribbon 440. Coupling of the ribbon 440 to the base 401 can be achieved in any suitable manner, such as any of the manners discussed above. In the illustrated embodiment, the ribbon 440 is coupled to the base 401 via frictional engagement without any adhesives or other fastening devices.

Figure 14B:
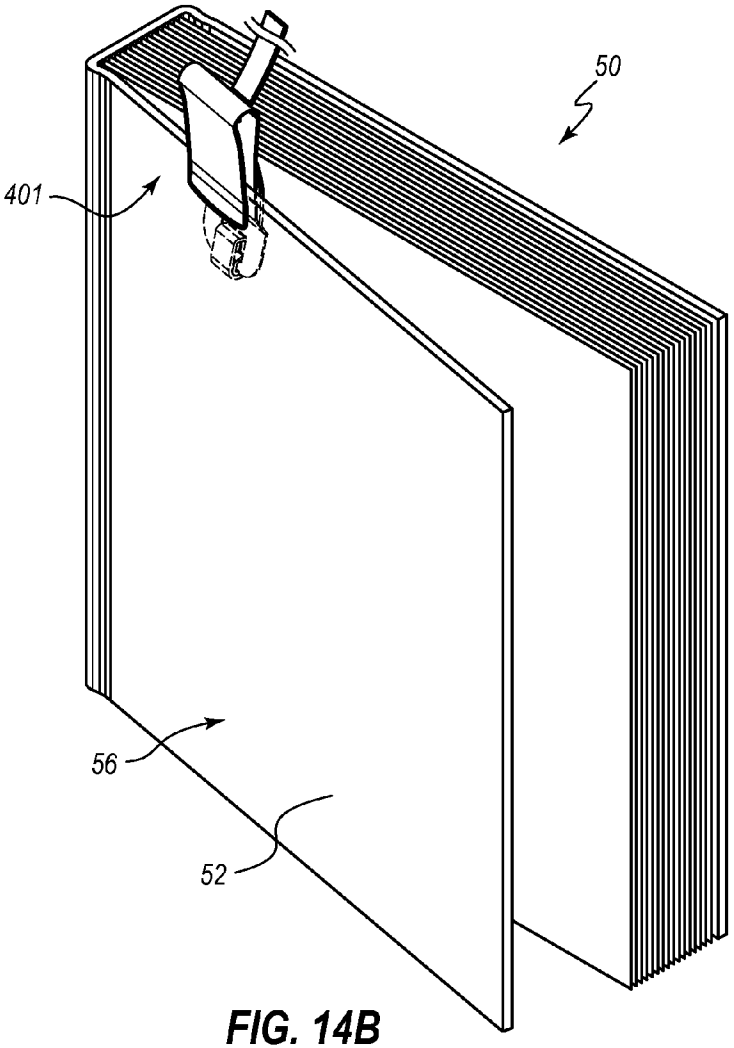
FIG. 14B is a perspective view of a later stage of coupling the bookmark of FIG. 13A with the cover of the book.
Figure 14A:
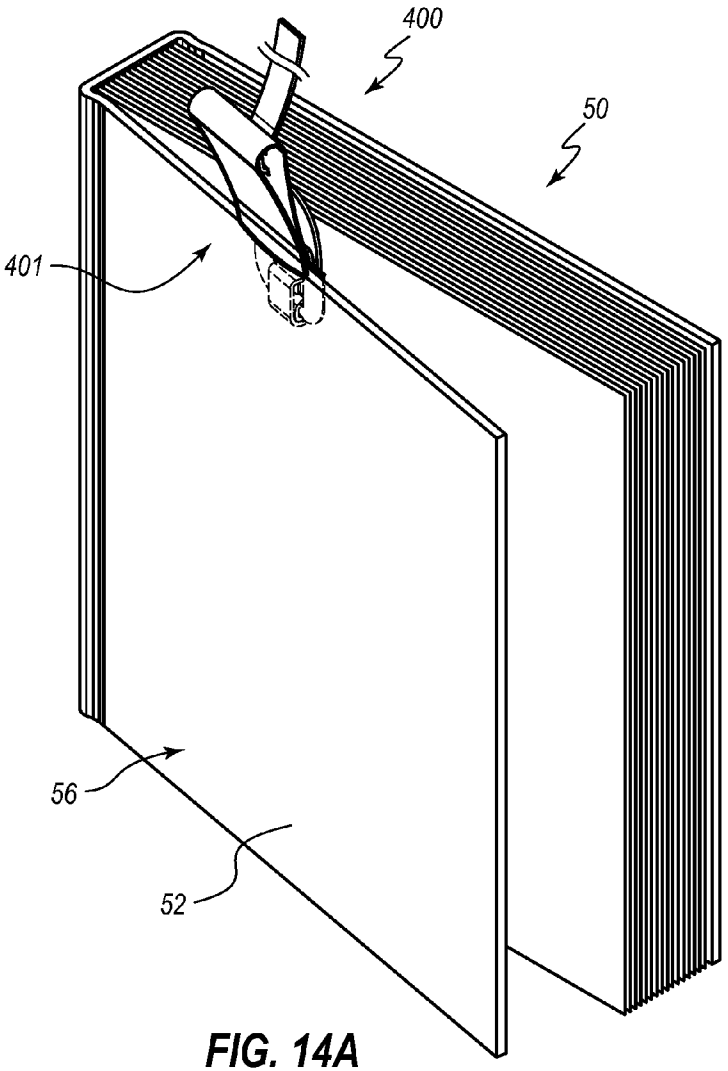
FIG. 14A is a perspective view of an early stage of coupling the bookmark of FIG. 13A with a cover of a book.

As shown in FIGS. 14A and 14B, the bookmark 400 can be particularly suited for coupling with the cover 52 of a book 50. The cover 52 may be of a hardback or paperback variety, as further discussed below. In the illustrated embodiment, the cover 52 is a relatively thick hardback variety, and the bookmark 400 is coupled with the front cover flap 56 of the book 50. As discussed further hereafter, the base 401 can act as a clip. A first portion of the base 401 can be visible at a front face of the book 40, and another portion of the base 401 can be inserted between the front cover flap 56 of the book 50 and the pages of the book 50. Both portions of the base 401 can cooperate to attach the bookmark 400 to the cover 52. In some embodiments, the base 401 is formed of a unitary piece of material.

With reference to FIGS. 15A-15E, certain embodiments of the base 401 include a clamp-like display body 414, which can extend forwardly over the front cover flap 56 and cooperate with a rigid body 416 to attach the bookmark 400 to the cover flap 56. Together, the rigid body 416 and the display body 414 may be referred to as a clip.

The display body 414 can be connected to the rigid body 416 via a transition region 450. In the illustrated embodiment, the transition region 450 defines a rounded profile and extends from an upper end of the rigid body 416 to an upper end of the display body 414. The transition region 450 can be resiliently deformable so as to bias a bottom end of the display body 414 toward the rigid body 416. Together, the transition region 450 and the display body 414 can be referred to as a biasing member 452. In some embodiments, the rigid body 416, the display body 414, and the transition region 450 may be unitarily formed of any suitable material, such as, for example, metal or plastic. The transition region 450 may also be referred to as a hinge.

In a natural or resting state, the display body 414 can be angled from the transition region 450 toward a clamping region 455. The clamping region 455 can include a clamping portion 456 of the display body 414 that is configured to cooperate with a clamping portion 458 of the rigid body 416 to secure the base 401 to the book 50. In the illustrated embodiment, the clamping portions 456, 458 are each substantially planar and rectangular and are configured to contact each other (see FIG. 15D) when they are in an approximated or initial state, in which the base 401 has not yet been attached to a book. Such an arrangement can ensure that the clamping portions 456, 458 will each contact opposite sides of a cover of the book when the base 401 is coupled with the book in a deployed, gripping, or clamping state. In other embodiments, the clamping portions 456, 458 may define other shapes or configurations. For example, the clamping portions 456, 458 may be rounded or otherwise non-planar and/or may not contact each other when they are in the approximated or initial state.

In the illustrated embodiment, a left edge and a right edge of the display body 414 are substantially aligned with the left and right edges of the rigid body 416, respectively. Moreover, the left and right edges of the display body 414 and the rigid body 416 are coextensive along a longitudinal length of the clamping region 455. Stated otherwise, an effective area of the clamping region 455 can extend along substantially a full width of the base 401. Such an arrangement can provide for an even, consistent, or distributed attachment force.

The display body 414 can include a display region 459 at which any suitable display may be provided, such as, for example, on a plate, sticker, or other item that is initially separate from the display body 414 and is attached to the display body 414 in any suitable fashion (e.g., adhesives or welding). The display may be provided to the display region 459 in any other suitable manner, such as by painting, or may be integral to or removed from the display body (e.g., raised features, stamped features, cutouts, or etchingsa decorative sticker, printed image, raised design). In the illustrated embodiment, a cavity or recess defines the display region 459, which may be configured to receive a decorative sticker or plate.

Figure 15A:
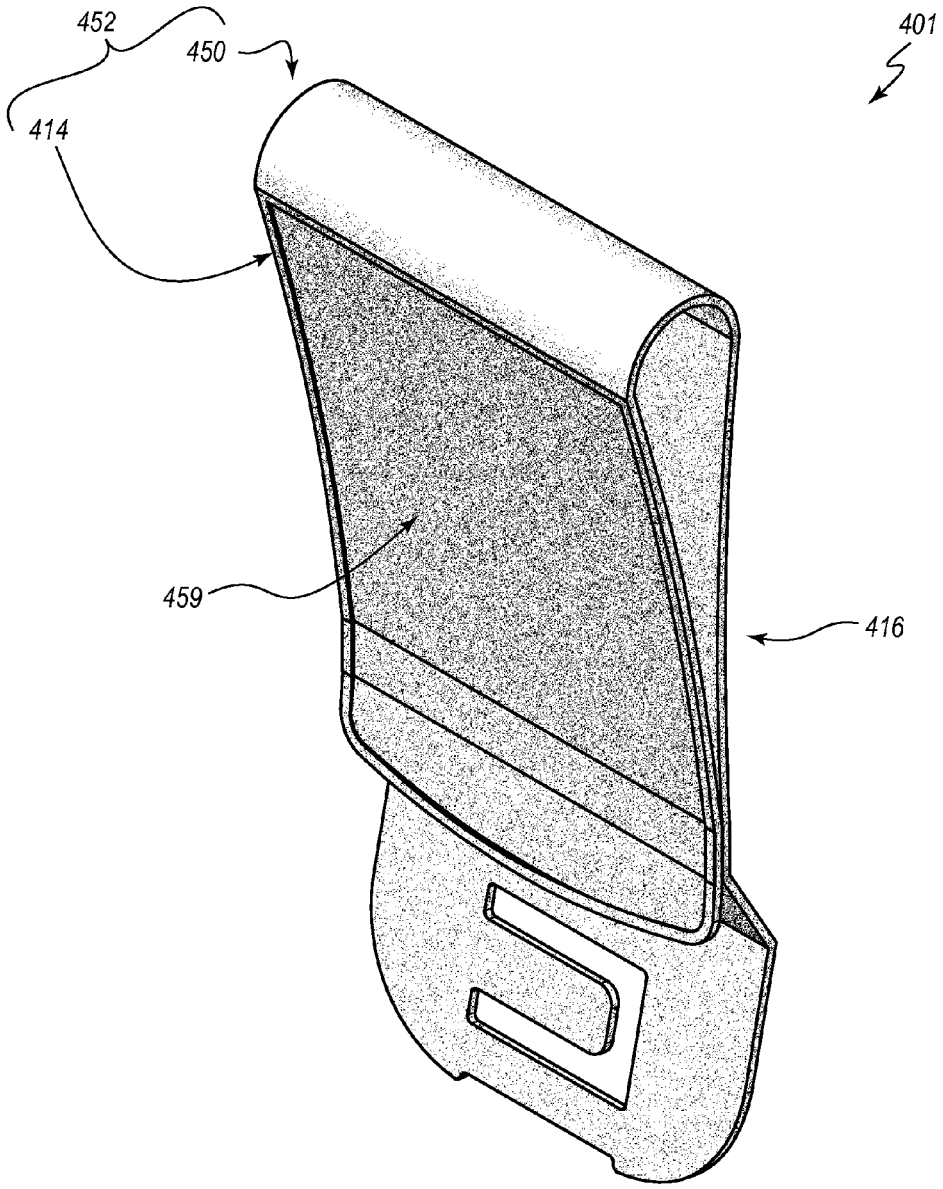
FIG. 15A is a front perspective view of an embodiment of a base portion of the bookmark of FIG. 13A.
Figure 15C:
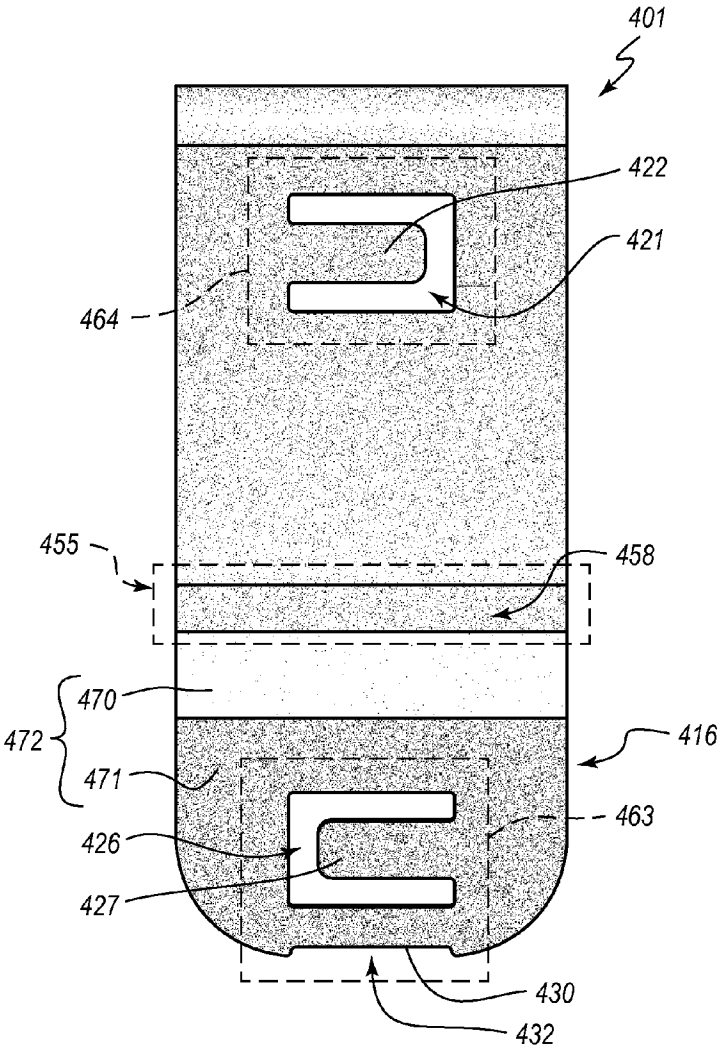
FIG. 15C is a rear plan view of the base of FIG. 15A.

With reference to FIG. 15C, the rigid body 416 can define lower and upper attachment regions 463, 464 at which the ribbon 440 can be secured to the rigid body 416. Any suitable arrangement for the attachment regions 463, 464 is possible, including any of those discussed above. In the illustrated embodiment, the lower attachment region 463 includes a lower opening 426 that encompasses a free end of a lower shelf member 427, and further includes a notch 430 that defines a recess 432. The upper attachment region 464 includes an upper opening 421 that encompasses a free end of an upper shelf member 422.

Figure 15B:
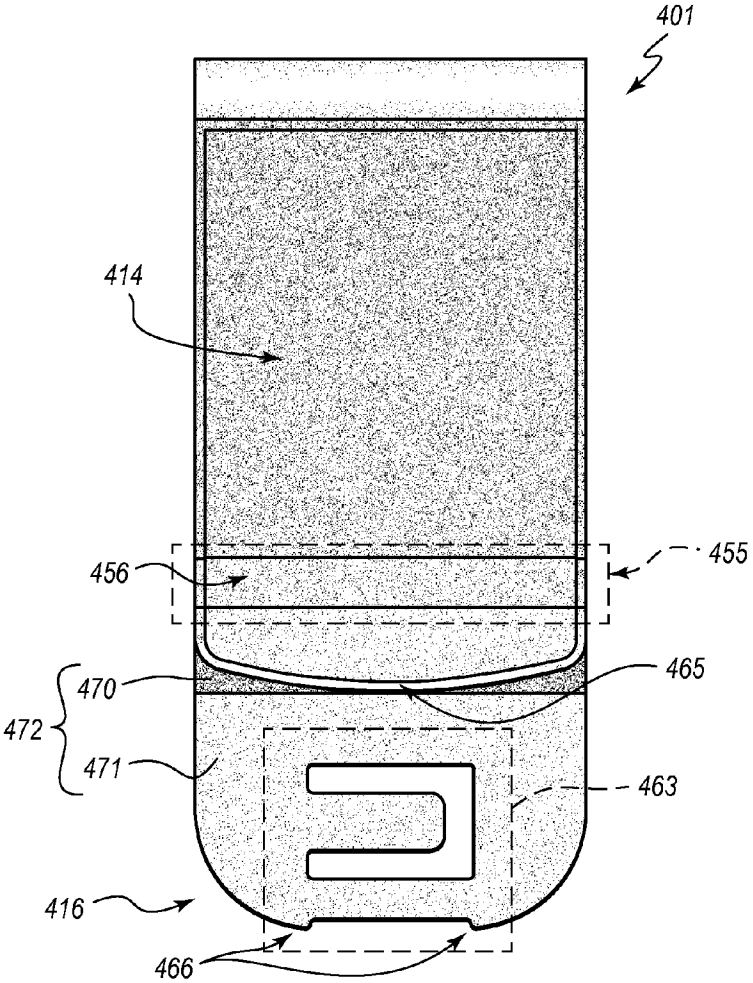
FIG. 15B is a front plan view of the base of FIG. 15A.

As can be seen in FIG. 15B, a bottom end 465 of the display body 414 can be spaced from the lower attachment region 463. This can permit the ribbon 440 to be readily passed through the lower opening 426 and looped about the lower shelf member 427. Stated otherwise, the ribbon 440 can be passed through the opening 426 without hindrance from the display body 414. A bottom end of the rigid body 416 can include one or more end points 466, which can be at the bottommost edge of the rigid body 416. In the illustrated embodiment, two end points 466 are at either side of the notch 430.

Figure 15D:
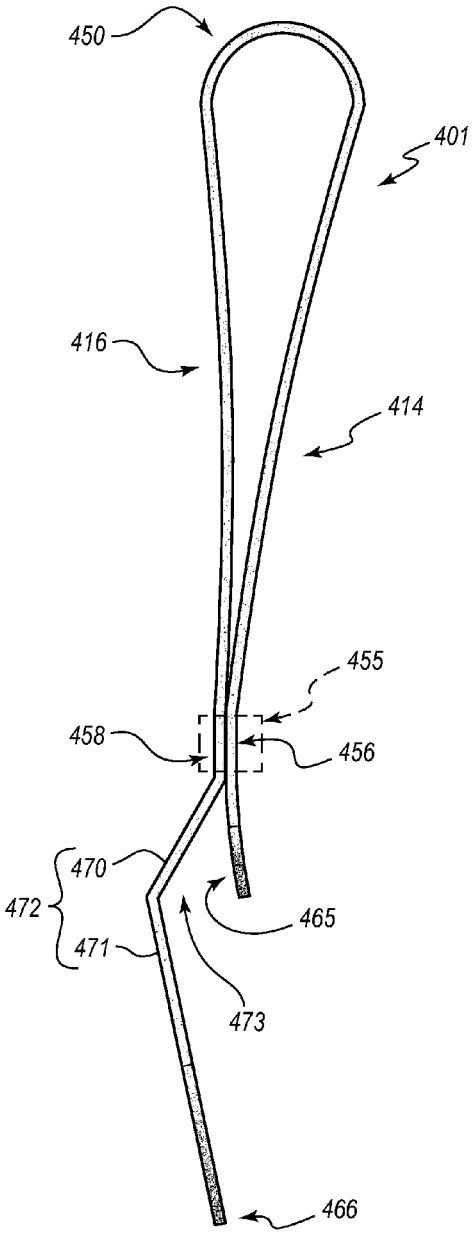
FIG. 15D is a left side elevation view of the base of FIG. 15A.

As shown in FIGS. 15B-15D, the rigid body 416 can define a rearward deviation or coupling assist region 472, which can be configured to aid in coupling the bookmark 400 to the book 50. In the illustrated embodiment, the coupling assist region 472 includes an upper panel 470 and a lower panel 471. The upper panel 470 extends rearwardly and downwardly away from a bottom end of the clamping region 455. In particular, the upper panel 470 extends rearwardly so as to be spaced from the bottom end 465 of the display body 414.

Figure 15E:
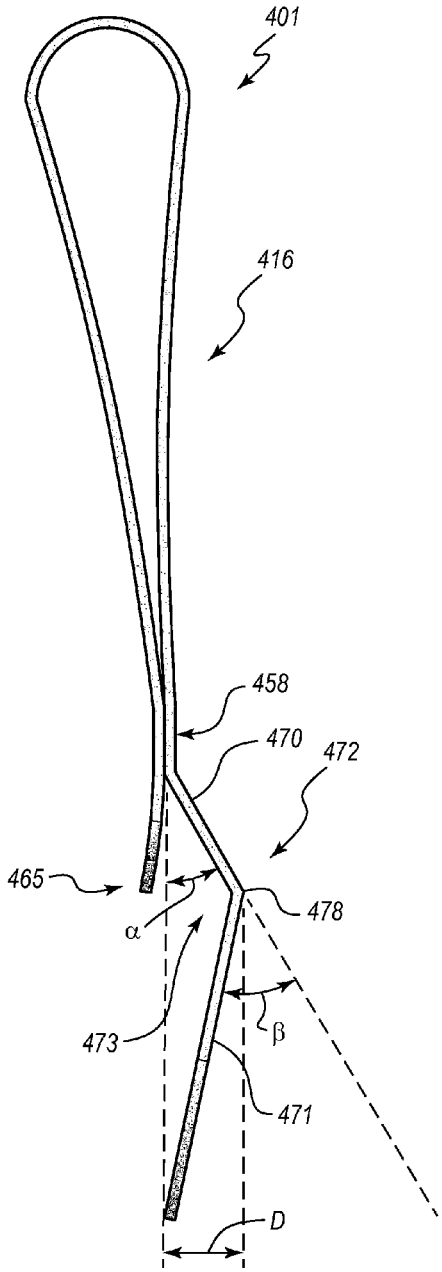
FIG. 15E is a right side elevation view of the base of FIG. 15A.
Figure 15F:
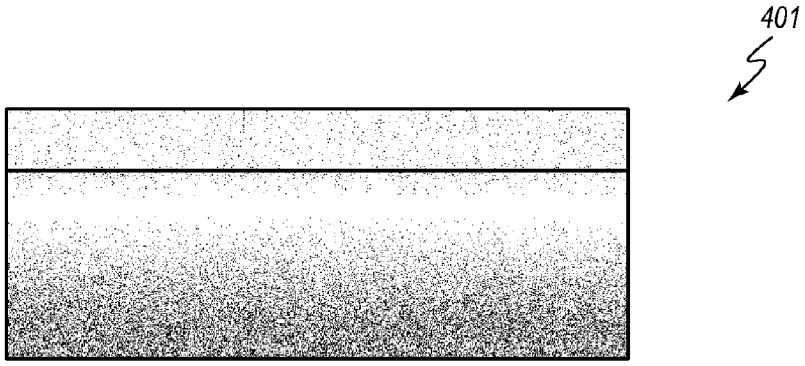
FIG. 15F is a top plan view of the base of FIG. 15A.
Figure 15G:
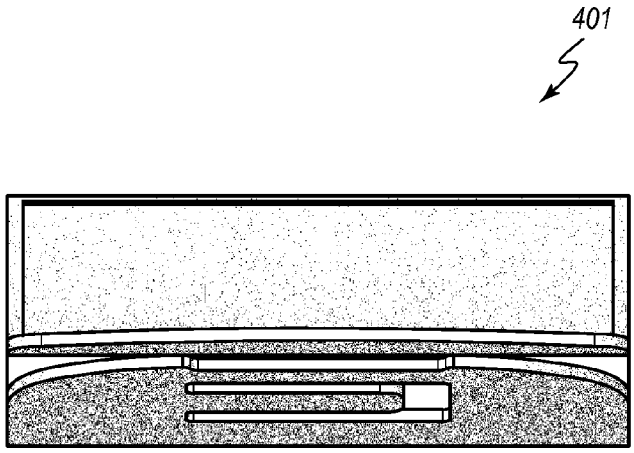
FIG. 15G is a bottom plan view of the base of FIG. 15A.

As shown in FIG. 15E, the upper panel 470 can be substantially planar. The upper panel 470 can define an angle $\alpha$ relative to a tangent line that extends from the clamping portion 458 of the rigid body 416. In the illustrated embodiment, the lower panel 471 is also substantially planar. The lower panel 471 defines an angle $\beta$ relative to the upper panel 470. In the illustrated embodiment, the angle $\beta$ is greater than the angle $\alpha$. One or more of the upper and lower panels 470 can define a slot, receptacle, recess, depression, gap, void, or cavity 473 that provides an empty volume behind the bottom end 465 of the display body 414. As discussed further below, the cavity 473 can be sized to receive an edge of a book cover 52 therein, and the upper and/or lower panels 470, 471 can assist in opening the clamping region 455 so that the base 401 can be advanced onto the book cover 52. The bottom end 465 of the display body 414 may curve forwardly, which may also assist in introducing the book cover 52 into the cavity 473.

The coupling assist region 472 can extend rearwardly relative to an upper portion of the rigid body 416 so as to define a depth D. For example, in the illustrated embodiment, an apex line 478 that extends along a back end of the upper and lower panels 470, 471 can be spaced from the tangent line that extends downwardly from the clamping portion 458 by the depth D. The depth D can be greater than an thickness of the rigid body 416. For example, in various embodiments, the depth D is no less than about 1.5, 2.0, 2.5, 3.0, 3.5, or 4.0 times greater than a maximum thickness of the rigid body 416.

FIGS. 16A-16D depict various stages of an illustrative procedure for coupling the bookmark 400 with a cover 52 of a book 50. In the illustrated procedure, the bookmark 400 is coupled with the front cover flap 56 of the book, although other suitable coupling positions are also possible. It is noted that in FIGS. 16A-16C, the ribbon 440 is shown in a somewhat loose position, whereas in FIG. 16D, the ribbon 440 has been tightened. In other procedures, it can be desirable to tighten the ribbon 440 prior to coupling the bookmark 400 with the book 50 (e.g., prior to the stage illustrated in FIG. 16A).

Figure 16B:
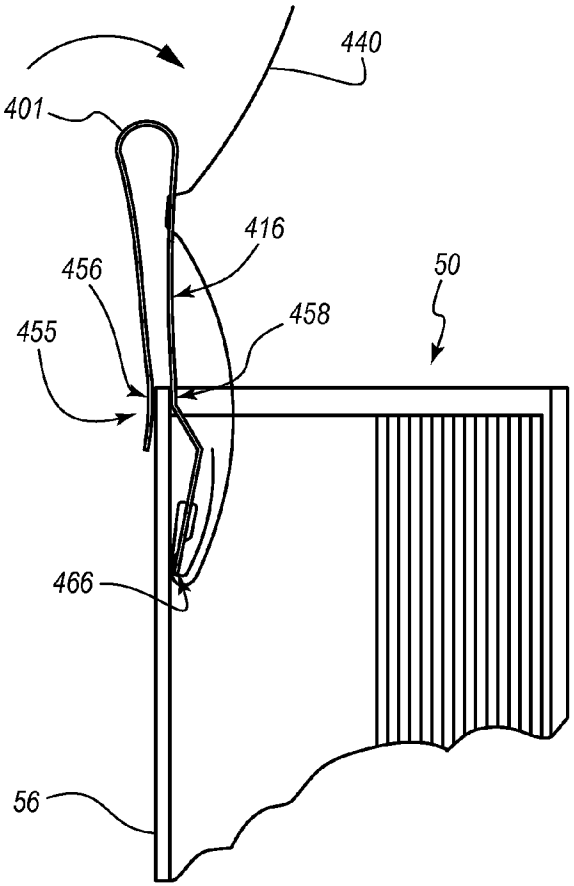
FIG. 16A-16D are side elevation views of various stages of coupling the bookmark of FIG. 13A with the cover of a book.
Figure 16A:
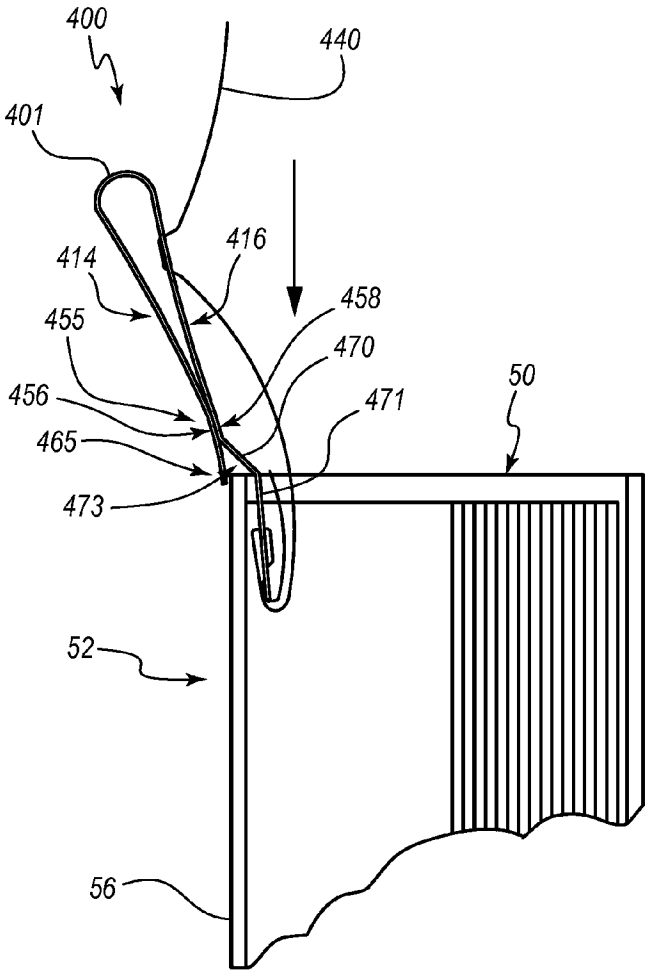

With reference to FIG. 16A, the base 401 of the bookmark 400 is tilted forward, such that the lower panel 471 of the rigid body 416 is parallel or nearly parallel to the front cover flap 56. Such an orientation can facilitate introduction of an upper end of the front cover flap 56 into the cavity 473. The upper end of the front cover flap 56 can desirably be advanced between the bottom end 465 of the display body 414 and the lower panel 471 of the rigid body 416.

The bookmark 400 can be advanced downwardly, as indicated by the bolded arrow. In FIG. 16A, the bookmark 400 is shown just before the top edge of the front cover flap 56 comes into contact with the upper panel 471 of the rigid body 416. Moreover, the clamping region 455 is shown in a non-separated, closed, or initial state, in which the front and rear clamping portions 456, 458 are in contact with, or in close proximity to, each other.

FIG. 16B depicts a later stage of the coupling of the bookmark 400 with the front cover flap 56. To arrive at this stage, the base 401 is urged downward even further such that the top edge of the front cover flap 56 contacts the upper panel 471 of the rigid body 416. Due to the slanted arrangement of the upper panel 471, continued downward movement of the bookmark 400 causes the top edge of the front cover flap 56 to pry or otherwise urge apart the front and rear clamping portions 456, 458.

In addition to being moved downwardly relative to the front cover flap 56, the base 401 may also be rotated rearwardly, as indicated by the bolded arrow. Such movement can assist in opening the clamping region 455. This movement can also bring the end points 466 of the rigid body 416 in contact with or in close proximity to the rear face of the front cover flap 56. For example, in some embodiments, the ribbon 440 is thick enough to prevent to the end points 466 from contacting the front cover flap 56. The ribbon 440 may be soft and/or the end points 466 may be rounded or otherwise configured so as not to leave any marks or creases at the inner face of the front cover flap 56.

In some arrangements, rotating the base 401 rearwardly can assist in opening the clamping region 455, as the lower end of the rigid body 416 can act as a pivot and cause the upper end of the front cover flap 56 to move the display body 414 forwardly. However, in other arrangements, the base 401 may be inserted over the front cover flap 56 with relatively little or no rotation. For example, the angled surface of the upper panel 470 and/or the forwardly curved bottom end 465 of the display body 414 can provide clearance for a thickness of the front cover flap 56, such that the base 401 may be translated downwardly without rotation. In certain of such arrangements, interaction between the upper end of the front cover flap 56 and the angled upper panel 470 can cause the clamping portions 456, 458 to separate from each other and permit the base 401 to be further advanced over the front cover flap 56.

Figure 16D:
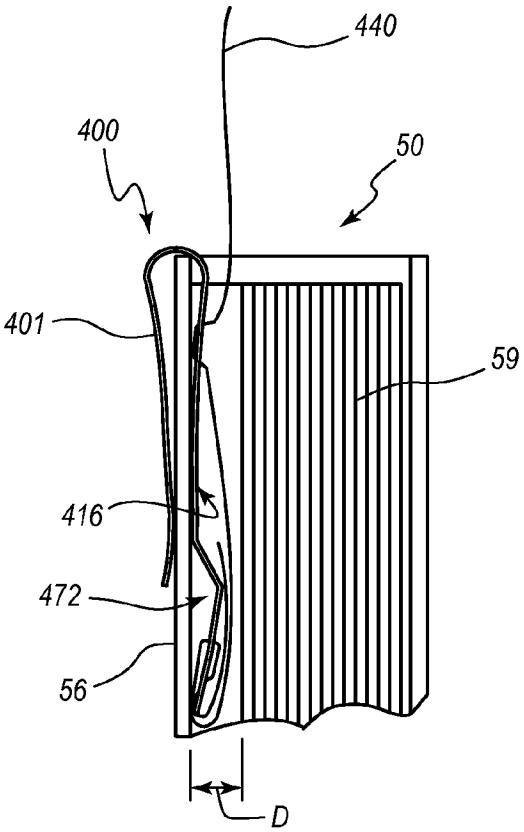
Figure 16C:
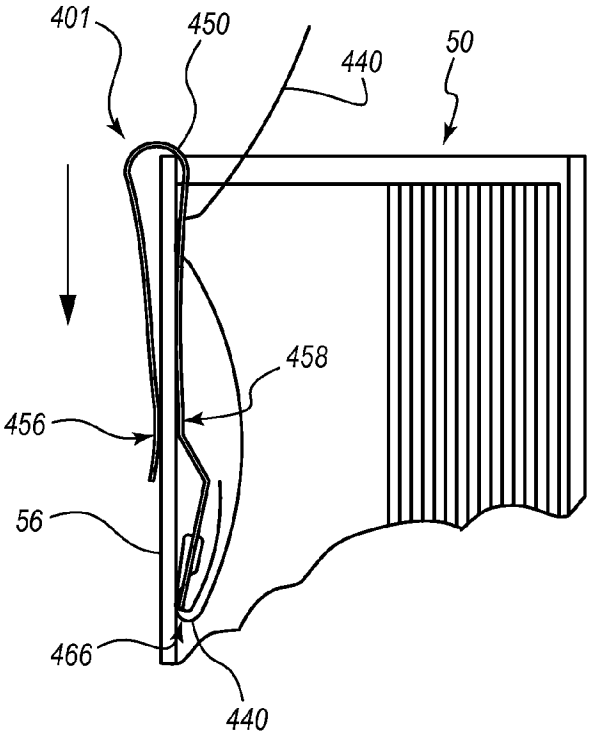

With reference to FIG. 16C, the body 401 can be advanced further onto the front cover flap 56. In the illustrated arrangement, the top edge of the front cover flap 56 can contact an interior surface of the transition region 450. This additional contact may provide stability to the body 401, which also clamps the front cover flap 56 between the front and rear clamping portions 456, 458.

As shown in FIG. 16D, the book 50 can be closed after the bookmark 400 has been secured to front cover flap 56. Due to the depth D that results from the coupling assist region 472, the cover flap 56 may be spaced further from the pages 59 of the book 50 than it would be in the absence of the bookmark 400. Accordingly, in some embodiments, it may be desirable for the depth D to be relatively small such that the front cover flap 56 is raised by only a small or negligible amount when the book 50 is closed. In some embodiments, the depth D can be adjustable. For example, the rigid body 416 may be relatively rigid in a longitudinal direction, but more flexible in the depth direction such that the coupling assist region 472 may be readily compressed between the front cover flap 56 and the pages 59. However, in other embodiments, the coupling assist region 472 may be relatively inflexible. In various embodiments, the depth D may be no greater than about 1, 2, 3, or 4 millimeters.

From the foregoing disclosure, it can be appreciated that the bookmark 400 can be readily coupled with either hardback or paperback books. Various arrangements, such as those described, can allow for simple coupling of the bookmark 400 with the cover 52 such that a top edge of the cover 52 is not damaged by the coupling, which may be particularly advantageous for paperback books. Moreover, the arrangements can be particularly well-suited for coupling the bookmark 400 with hardback covers 52, which may be relatively thicker. Such advantages can result from the coupling assist region 472 as previously described.

Other arrangements than those specifically described and illustrated in the drawings will be evident based on the present disclosure. For example, although the upper and lower panels 470, 471 are described as being planar in some embodiments, in other embodiments, the panels 470, 471 may be rounded or otherwise nonplanar. For example, one or more of the panels 470, 471 may be replaced with a convexly rounded region.

Figure 17A:
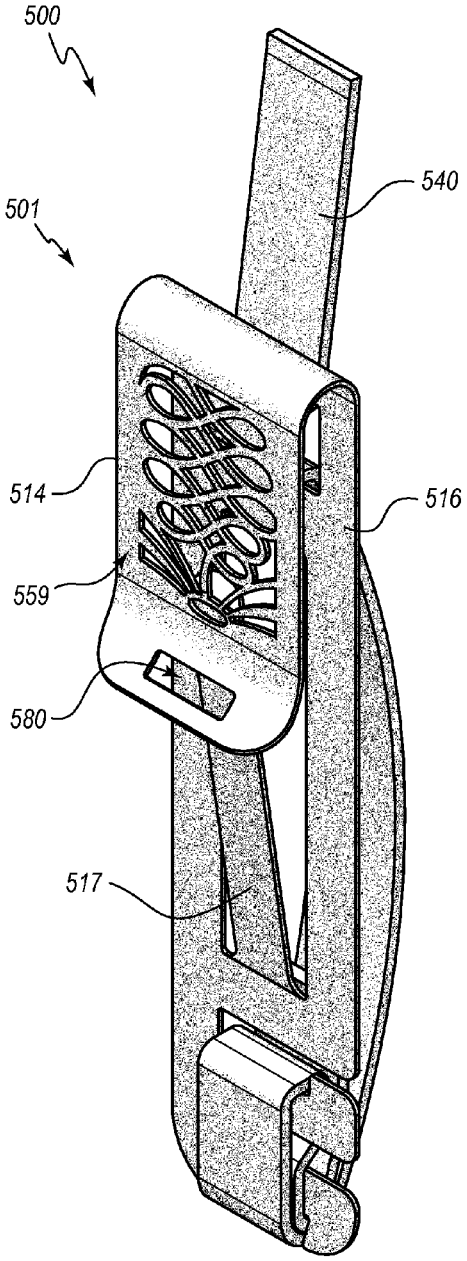
FIG. 17A is a front perspective view of another embodiment of a bookmark.
Figure 17B:
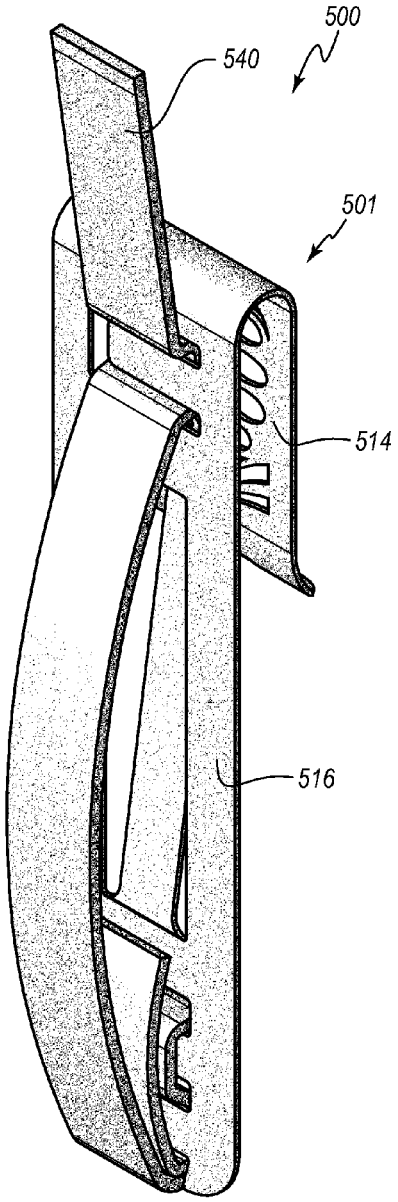
FIG. 17B is a rear perspective view of the bookmark of FIG. 17B.

FIGS. 17A and 17B illustrate an embodiment of a bookmark 500, which can particularly resemble the bookmark 100 described above. The bookmark 500 includes a base 501 that can be coupled with a ribbon 540 in any suitable manner. The base 501 can include a display body 514, a rigid body 516, and a spring member 517. The display body 514 can include a display region 559, which, in the illustrated embodiment, includes a cutout design. In some embodiments, a lower end of the display body 514 can curve forwardly. In other or further embodiments, the lower end of the display body 514 can define an attachment port 580, at which any suitable ornamental feature can be attached to the display body 514. For example, in some embodiments, a charm may be clipped to the display body 514 at the attachment port 580.

It will be understood by those having skill in the art that changes may be made to the details of the above-described embodiments without departing from the underlying principles presented herein. For example, any suitable combination of various embodiments, or the features thereof, is contemplated. Additional embodiments of bookmarks with which features disclosed herein may be used are disclosed in U.S. patent application Ser. No. 12/749,778, titled BOOKMARKS FOR USE WITH HARDBACK BOOKS AND RELATED METHODS, filed Mar. 30, 2010; and U.S. patent application Ser. No. 12/749,871, titled BOOKMARKS INCLUDING RIBBON HOLDING FEATURES AND RELATED METHODS, filed Mar. 30, 2010, the entire contents of each of which are hereby incorporated by reference herein. Moreover, additional bookmarks with which any of the features discussed herein can be used are disclosed in U.S. Design Pat. Nos. D624,587; D624,588; D624,589; D624,590; D629,844; D629,845; D632,331; and D634,363, the entire contents of each of which are hereby incorporated by reference herein. For example, any suitable ribbon arrangement from the foregoing applications and patents may be used with any of the bookmark bases disclosed herein. Thus, any of the views of the ribbons shown in the foregoing design patents can be used with corresponding views of the bases disclosed herein.

Any methods disclosed herein comprise one or more steps or actions for performing the described method. The method steps and/or actions may be interchanged with one another. In other words, unless a specific order of steps or actions is required for proper operation of the embodiment, the order and/or use of specific steps and/or actions may be modified.

Reference throughout this specification to "an embodiment" or "the embodiment" means that a particular feature, structure or characteristic described in connection with that embodiment is included in at least one embodiment. Thus, the quoted phrases, or variations thereof, as recited throughout this specification are not necessarily all referring to the same embodiment.

Similarly, it should be appreciated that in the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description. These additional embodiments are determined by replacing the dependency of a given dependent claim with the phrase "any of the preceding claims up to and including claim [x]," where the bracketed term "[x]" is replaced with the number of the most recently recited independent claim. For example, for the first claim set that begins with independent claim 1, claim 3 can depend from either of claims 1 and 2, with these separate dependencies yielding two distinct embodiments; claim 4 can depend from any one of claims 1, 2, or 3, with these separate dependencies yielding three distinct embodiments; claim 5 can depend from any one of claims 1, 2, 3, or 4, with these separate dependencies yielding four distinct embodiments; and so on. Similarly, for the second claim set that begins with independent claim 11, claim 13 can depend from either of claims 11 and 12, with these separate dependencies yielding two distinct embodiments; claim 14 can depend from any one of claims 11, 12, or 13, with these separate dependencies yielding three distinct embodiments; and claim 15 can depend from any one of claims 11, 12, 13, or 14 with these separate dependencies yielding four distinct embodiments.

Recitation in the claims of the term "first" with respect to a feature or element does not necessarily imply the existence of a second or additional such feature or element. Elements specifically recited in means-plus-function format, if any, are intended to be construed in accordance with 35 U.S.C. §112 ¶ 6. Embodiments of the invention in which an exclusive property or privilege is claimed are defined as follows.

The invention claimed is:

1. A bookmark comprising:

a display body that is configured to be positioned at an exterior of a cover of a book when the bookmark is coupled with the book, wherein the display body comprises a first clamping portion; and a rigid body coupled with the display body such that the rigid body is configured to be positioned at an interior of a cover of a book when the bookmark is coupled with the book, wherein the rigid body comprises a second clamping portion that is configured to cooperate with the first clamping portion to maintain the bookmark coupled with a cover of a book, wherein the rigid body comprises a coupling assist region that comprises a cavity that extends rearwardly relative to the display body, wherein the cavity is positioned below the second clamping portion such that an edge of a book cover can be received into the cavity before being advanced between the first and second clamping portions, and wherein the coupling assist region comprises an upper panel and a lower panel that are angled relative to each other.

2. The bookmark of claim 1, wherein one or more of the upper and lower panels are substantially planar.

3. The bookmark of claim 1, wherein the lower panel comprises a first attachment region at which a ribbon can be coupled with the rigid body.

4. The bookmark of claim 3, wherein the rigid body comprises a second attachment region at an upper end thereof.

5. The bookmark of claim 1, wherein a bottom end of the display body extends downwardly in front of the cavity.

6. The bookmark of claim 5, wherein the bottom end of the display body is curved forwardly.

7. The bookmark of claim 1, wherein the coupling assist region defines a depth that is greater than a maximum thickness of the rigid body.

8. The bookmark of claim 1, wherein the display body and the rigid body are hinged to each other so as to cooperate with each other to clip the bookmark to a cover portion of a book.

9. The bookmark of claim 1, wherein the display body and the rigid body are integrally formed from a unitary piece of material.

10. A bookmark assembly comprising:

a display body that is configured to be positioned at an exterior of a cover of a book when the bookmark is coupled with the book, wherein the display body comprises a first clamping portion;

a rigid body coupled with the display body such that the rigid body is configured to be positioned at an interior of a cover of a book when the bookmark is coupled with the book, wherein the rigid body comprises a second clamping portion that is configured to cooperate with the first clamping portion to maintain the bookmark coupled with a cover of a book, wherein the rigid body comprises a coupling assist region that comprises a cavity that extends rearwardly relative to the display body; and a ribbon coupled with the rigid body at a position below the second clamping portion.

11. The bookmark assembly of claim 10, wherein the cavity is positioned below the second clamping portion such that an edge of a book cover can be received into the cavity before being advanced between the first and second clamping portions.

12. The bookmark assembly of claim 10, wherein the rigid body further comprises an upwardly extending notch at the lower end of the rigid body that defines a recess, and wherein one or more portions of the ribbon that extend about the lower end of the rigid body are received within the recess defined by the notch.

13. The bookmark assembly of claim 12, wherein two separate portions of the ribbon are positioned within the recess and frictionally engage each other.

14. The bookmark assembly of claim 10, wherein the coupling assist region comprises an upper panel and a lower panel that are angled relative to each other.

15. The bookmark assembly of claim 14, wherein one or more of the upper and lower panels are substantially planar.

16. The bookmark assembly of claim 10, wherein the ribbon is further coupled with the rigid body at a position above the second clamping portion.

17. The bookmark assembly of claim 10, wherein the coupling assist region defines a depth that is greater than a maximum thickness of the rigid body.

* * * * *